US007555251B2

(12) United States Patent
Sato

(10) Patent No.: US 7,555,251 B2
(45) Date of Patent: Jun. 30, 2009

(54) IMAGE FORMING APPARATUS AND TONER CARTRIDGE

(75) Inventor: Shougo Sato, Seto (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 565 days.

(21) Appl. No.: 11/425,217

(22) Filed: Jun. 20, 2006

(65) Prior Publication Data

US 2008/0298836 A1 Dec. 4, 2008

(30) Foreign Application Priority Data

Dec. 1, 2005 (JP) ..... 2005-348116

(51) Int. Cl.
*G03G 15/06* (2006.01)

(52) U.S. Cl. ..... 399/262; 399/119; 399/120; 399/263; 399/124; 399/388

(58) Field of Classification Search ..... 399/107, 399/111, 119, 120, 262, 388, 124
See application file for complete search history.

(56) References Cited

U.S. PATENT DOCUMENTS

| | | | | |
|---|---|---|---|---|
| 5,608,501 | A | 3/1997 | Makino | |
| 5,867,755 | A | 2/1999 | Sato | |
| 6,041,203 | A | 3/2000 | Suzuki | |
| 6,330,410 | B1 | 12/2001 | Okabe | |
| 6,411,789 | B1 | 6/2002 | Okabe | |
| 6,546,217 | B2 | 4/2003 | Okabe | |
| 6,690,903 | B2 | 2/2004 | Okabe | |
| 6,741,820 | B2 | 5/2004 | Nobe | |
| 6,873,810 | B2 | 3/2005 | Okabe | |
| 7,019,870 | B2 | 3/2006 | Kameyama | |
| 7,035,568 | B2 | 4/2006 | Sato | |
| 2004/0247337 | A1 | 12/2004 | Ohama | |
| 2005/0129442 | A1 | 6/2005 | Matsumoto | |
| 2005/0135837 | A1 | 6/2005 | Okabe | |
| 2006/0029419 | A1 * | 2/2006 | Shiraki | 399/111 |
| 2006/0056876 | A1 | 3/2006 | Okabe | |
| 2006/0056877 | A1 | 3/2006 | Okabe | |
| 2006/0056878 | A1 | 3/2006 | Okabe | |
| 2007/0092292 | A1 * | 4/2007 | Ito | 399/124 |
| 2007/0160381 | A1 * | 7/2007 | Sato et al. | 399/107 |
| 2008/0025756 | A1 * | 1/2008 | Ahn et al. | |

* cited by examiner

*Primary Examiner*—David M Gray
*Assistant Examiner*—G. M. Hyder
(74) *Attorney, Agent, or Firm*—Banner & Witcoff, Ltd.

(57) ABSTRACT

An image forming apparatus includes: an image carrier on which an electrostatic latent image is formed; a toner cartridge detachably mountable to the image forming apparatus, including a toner casing accommodating a developing agent, an opening/closing member which opens/closes an opening formed in the toner casing to discharge the developing agent, and an operation member operating the opening/closing member; and a developing unit to develop the electrostatic latent image by the developing agent discharged from the opening. The operation member can move between an open position for operating the opening/closing member to open the opening, and a close position for operating the opening/closing member to close the opening, and the operation member forms a part of a transport path of a recording medium in the image forming apparatus at the open position in a state where the toner cartridge is mounted in the image forming apparatus.

20 Claims, 11 Drawing Sheets

IMAGE FORMING APPARATUS AND TONER CARTRIDGE

CROSS REFERENCE TO RELATED APPLICATION

This application claims priority from Japanese Patent Application No. 2005-348116, filed on Dec. 1, 2005, the entire subject matter of which is incorporated herein by reference.

FIELD

The present invention relates to an image forming apparatus such as a laser printer, and a toner cartridge detachably mountable to the image forming apparatus.

BACKGROUND

An image forming apparatus such as a laser printer, in which a sheet is fed from the upper portion of the image forming apparatus on the rear end portion side and is ejected from the front end portion thereof, for example, is known.

In such an image forming apparatus, a sheet arranged on a sheet feed cassette provided in an upper feeder section casing positioned at the rear end portion of an main body casing is transported along a transport path extending generally linearly from a feed roller provided in the feeder section casing to a photosensitive drum, a fixation unit and a sheet ejection tray on the front end side of the main body casing in this order.

SUMMARY

One aspect of the present invention relates to miniaturization of an image forming apparatus. According to at least same aspects of the present invention, the image forming apparatus includes: an image carrier on which an electrostatic latent image is formed; a toner cartridge detachably mountable to the image forming apparatus, including a toner casing accommodating a developing agent, an opening/closing member which opens/closes an opening formed in the toner casing to discharge the developing agent, and an operation member operating the opening/closing member; and a developing unit to develop the electrostatic latent image by the developing agent discharged from the opening, wherein the operation member can move between an open position for operating the opening/closing member to open the opening, and a close position for operating the opening/closing member to close the opening, and the operation member forms a part of a transport path of a recording medium in the image forming apparatus at the open position in a state where the toner cartridge is mounted in the image forming apparatus.

BRIEF DESCRIPTION OF DRAWING

FIG. 3 (*a*) shows the state that the toner cartridge is mounted in the developing unit, with its outer housing being in a toner open position. and a shutter of the developing unit is in a development open position.

FIG. 3 (*b*) shows the state that the toner cartridge is mounted in the developing unit, with its outer housing being in a toner close position, and the shutter of the developing unit is in a development close position.

FIG. 3 (*c*) is a side sectional view of a principal part of the process cartridge of the laser printer shown in FIG. 1, showing the state of the toner cartridge being dismounted from the developing unit.

FIG. 4 (*a*) shows the state that the toner cartridge is mounted in the developing unit, with its outer housing being in the toner open position, and the shutter of the developing unit is in the development open position.

FIG. 4 (*b*) shows the state that the toner cartridge is mounted in the developing unit, with its outer housing being in the toner close position, and the shutter of the developing unit is in the development close position.

FIG. 4 (*c*) is a right-side perspective view of the process cartridge of the laser printer shown in FIG. 1 as viewed from above and behind, showing the state of the toner cartridge being dismounted from the developing unit, FIG. 5 (*a*) is a right-side perspective view of the toner cartridge, as viewed from above and behind, its outer housing being in the toner close position.

DETAILED DESCRIPTION

Figure 1:
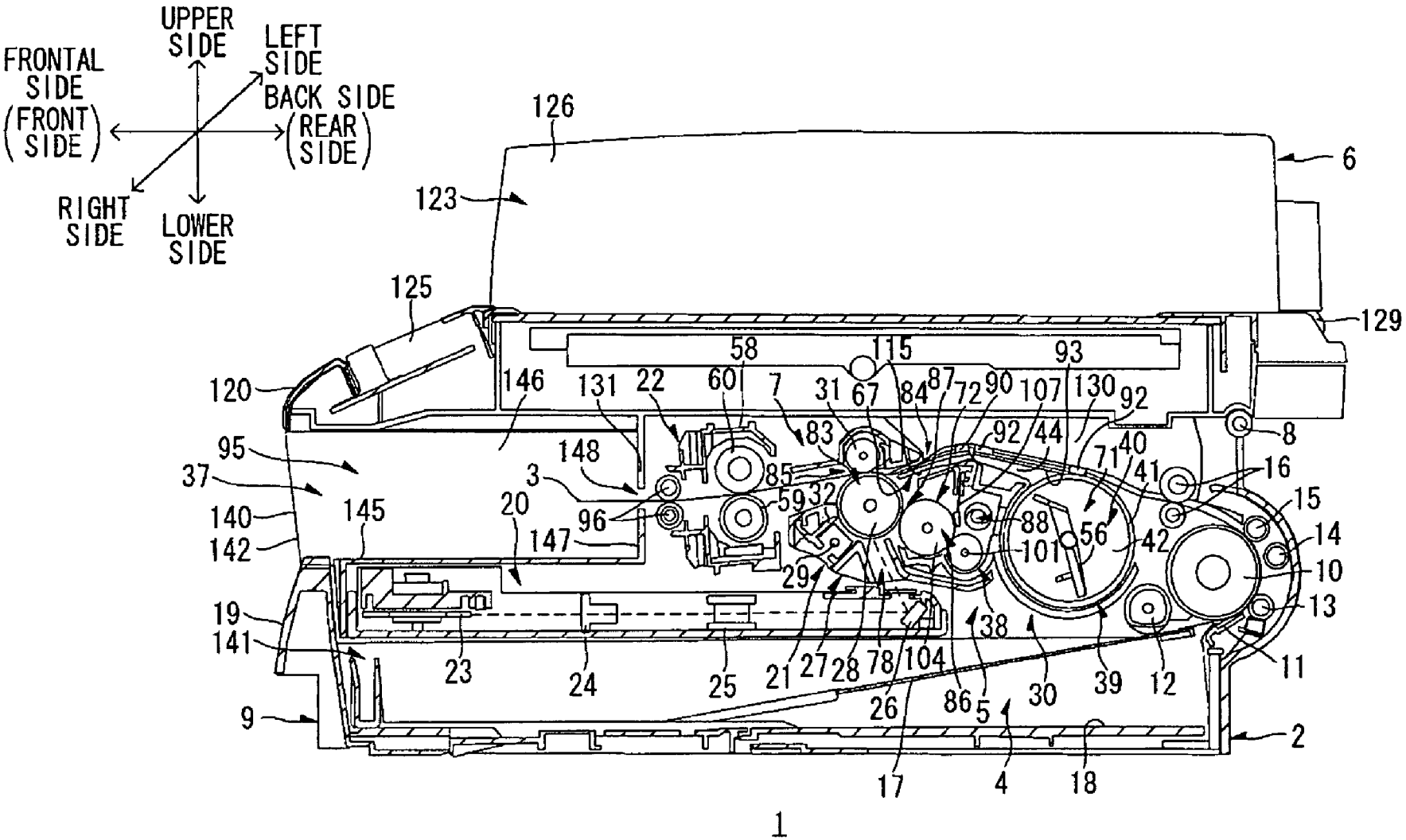
FIG. 1 is a side sectional view of a principal part of a laser printer as an embodiment of the present invention, showing the state of a flat bed unit bed being in a close position.

When a user feeds a sheet to an image forming apparatus while standing in front of the image forming apparatus, the user needs to stretch the hand to the upper portion of the image forming apparatus on the rear end portion side thereof. However, when the image forming apparatus is placed with its rear surface adjacent to a wall and the like, the image forming apparatus desirably allows a so-called front access with which a sheet can be both fed and ejected on the front side of the image forming apparatus.

In order to allow the front access with which a sheet can be both fed and ejected on the front side, the following structure is needed: a sheet feed tray and a sheet ejection tray are arranged in an up-and-down direction, and a sheet transport path from the sheet feed tray to the sheet ejection tray is formed such that its transporting direction is reversed (U-turned) in midway. A radius of curvature at a U-turn point of the transport path is important since it influences generation of a sheet jam at the time of transporting a sheet.

That is, the sheet is transported to turn in a small radius when the radius of curvature of U-turn is small. Therefore, the sheet after passing the U-turn point tends to curl particularly at its end portion on the downstream side of the sheet transporting direction, and is caught by components forming the transport pass, thereby to cause a sheet jam.

On the other hand, a sheet turns around in an increased radius when the radius of curvature of U-turn is large, and this can prevent the sheet after passing the U-turn point from being curled. Hence, the sheet can pass along the transport path smoothly to be transported to the sheet ejection tray.

In order to increase the radius of curvature at the U-turn point, the image forming apparatus may be increased in size in the up and down direction, and the transport path may be arranged so as to be close to the inner wall of the image forming apparatus. However, since the miniaturization of an image forming apparatus has been desired in recent years, it is needed to suppress a sheet jam while reducing the size of an image forming apparatus. Further, it is also important that when a jam is occurred, the jammed sheet can be easily removed.

Further, it is always desired to improve the efficiency of replacing a toner cartridge which is often replaced in an image forming apparatus. Accordingly, improving the efficiency of replacing a toner cartridge is also important.

Therefore, it is an object of the present invention to provide a toner cartridge, which can contribute to the miniaturization of an image forming apparatus, can achieve reliable sheet transport and image formation with few jams, and moreover, can achieve an easy jam treatment and is easy to replace, and an image forming apparatus which includes the toner cartridge, is high in operation reliability, and is small in size.

In order to achieve the above object, an image forming apparatus of the present embodiment includes: an image carrier on which an electrostatic latent image is formed; a toner cartridge detachably mountable to the image forming apparatus, including a toner casing accommodating a developing agent, an opening/closing member which opens/closes an opening formed in the toner casing to discharge the developing agent, and an operation member operating the opening/closing member; and a developing unit to develop the electrostatic latent image by the developing agent discharged from the opening, wherein the operation member can move between an open position for operating the opening/closing member to open the opening, and a close position for operating the opening/closing member to close the opening, and the operation member forms a part of a transport path of a recording medium in the image forming apparatus at the open position in a state where the toner cartridge is mounted in the image forming apparatus.

According to such a structure, a transport path sandwiching the toner cartridge in the up and down direction can be formed.

Therefore, a radius of curvature at a U-turn point of the transport path can be increased, whereby reliable transport of a recording medium can achieved while jams are suppressed.

Further, since the operation member forms a part of the transport path at the open position, the operation member can serves also as apart of the components forming the transport path. Thus, as compared with a case where a transport path is formed by a separate component, the number of components forming the transport path can be reduced, whereby the size of the image forming apparatus can be reduced.

Further, the toner cartridge can be easily replaced by operating the operation member.

When the operation member takes the open position, the inside of the toner casing accommodating the developing agent is communicated with the outside through the opening, and at the same time, the transport path of the recording medium is brought into completion by the operation member. Thus, a reliable ejection of the developing agent from the opening and a reliable transport of the recording medium can be achieved.

On the other hand, when the operation member takes the close position, the opening is closed by the opening/closing member, and at the same time, the transport path of the recording medium is not completed. Thus, the transport of the recording medium and the ejection of the developing agent can be reliably prevented.

Thus, operation reliability of the image forming apparatus can be further improved.

Further, preferably, the developing unit includes a development housing, and an introduction port opening/closing member which opens/closes an introduction port formed in the development housing to introduce the developing agent discharged from the opening of the toner cartridge, and in a state where the toner cartridge is mounted in the image forming apparatus and the operation member is at the open position, the introduction port is opened by opening operation of the introduction port opening/closing member, and the introduction port is closed by closing operation of the introduction port opening/closing member when the operation member is at the close position.

According to such a structure, in the state where the toner cartridge is attached in the image forming apparatus and the operation member is at the open position, when the opening of the toner casing is opened, the introduction port formed in the development housing is also opened at the same time. Then, the inside of the toner casing accommodating the developing agent and the inside of the development housing are communicated through the opening and the introduction port.

As a result, the developing agent can be reliably ejected from the toner casing and reliably introduced to the development housing.

On the other hand, when the operation member is at the close position, the opening is closed by the opening/closing member, and at the same time, the introduction port is closed by the introduction port opening/closing member.

Thus, the developing agent can be reliably prevented from being ejected from the toner casing and from being introduced to the development housing. Thus, the leakage of the developing agent can be reliably prevented.

As a result, the toner cartridge can be removed while preventing the leakage of the developing agent. Further, the leakage of the developing agent from the development housing after the removal of the toner cartridge can be prevented.

Further, preferably, the operation member takes a first position along the transport path of the recording medium when the operation member is at the open position, and the operation member takes a second position intersecting the transport path when the operation member is at the close position.

According to such a structure, the operation member takes the first position along the transport path to form a part of it when the operation member is at the open position. Thus, the transport path is completed, and reliable and smooth transport of the recording medium along the transport path can be achieved.

On the other hand, the operation member takes the second position intersecting the transport path when the operation member is at the close position. Thus, the transport path is not completed, and transport of the recording medium can be reliably prevented.

As a result, the completion of the transport path and the opening of the opening can be synchronized with each other to ensure a reliable image forming. Further, the incompletion of the transport path and the closing of the opening can be synchronized with each other to provide a reliable attachment and detachment of the toner cartridge.

Thus, operation reliability of the image forming apparatus can be further improved.

Further, preferably, a main body opening/closing member which is opened/closed when the toner cartridge is attached/detached to/from the image forming apparatus, is provided, and the operation member at the open position forms a part of the transport path, at a position opposed to the main body opening/closing member.

According to such a structure, the operation member forms a part of the transport path at the position opposed to the main body opening/closing member. Therefore, when the transported recording medium is jammed in the transport path, this recording medium can be exposed by opening the main body opening/closing member. Thus, the jammed transported recording medium can be easily removed.

Further, the operation member is exposed by opening the main body opening/closing member. Therefore, when the toner cartridge is detached from the image forming apparatus, the toner cartridge can be easily removed.

As a result, easy jam treatment and easy replacement of the toner cartridge can be achieved.

Further, in the state where the toner cartridge is mounted in the image forming apparatus, the operation member preferably interferes with a moving locus of the main body opening/closing member at the close position to make impossible closing of the main body opening/closing member.

According to such a structure, the main body opening/closing member cannot be closed when the operation member is at the close position, and the main body opening/closing member can be closed when the operation member is at the open position.

Therefore, after the opening of the toner casing is opened and the main body opening/closing member is closed, image forming operation can be reliably started.

Further, it can be easily determined whether the operation member is at the close position or the open position based on the fact whether the main body opening/closing member can be closed or not. Therefore, operability can be improved.

Further, at the position for forming a part of the transport path, the operation member preferably includes space keeping members projecting in a thickness direction of the transported recording medium from both end portions of the operation member in a direction orthogonal to a transporting direction of the recording medium.

According to such a structure, the space keeping members secure a space in the thickness direction of the transported recording medium at the position of the operation member for forming a part of the transport path.

Therefore, since the recording medium can pass this space, smooth transport of the recording medium can be achieved. Further, when the operation member is not sufficiently operated and is thus slightly displaced from the open position, the displacement of the operation member can be corrected by pressing the space keeping members.

Further, the operation member preferably includes a plurality of ribs arranged in the transporting direction of the recording medium between the space keeping members and projecting in the thickness direction of the transported recording medium to a smaller extent than the space keeping members.

According to such a structure, when the recording medium is transported, the friction can be reduced by the ribs. Moreover, since the ribs project in the thickness direction of the transported recording medium to a smaller extent than the space keeping members, a space can be secured between the space keeping members and the ribs in the projecting direction. Thus, the recording medium can be reliably transported along the ribs.

Further, preferably, an image forming apparatus includes: an image carrier on which an electrostatic latent image is formed; a toner cartridge detachably mountable to the image forming apparatus, including a cylindrical casing accommodating a developing agent, and a projecting member formed on an outer periphery of the casing; and a developing unit to develop the electrostatic latent image by the developing agent, and the toner cartridge is pivotable around a central axis of the casing in a state where the toner cartridge is mounted in the image forming apparatus, and the projecting member takes a first position along a transport path of a recording medium in the image forming apparatus and a second position intersecting the transport path when the toner cartridge is pivoted around the central axis, and the projecting member forms a part of the transport path at the first position.

According to such a structure, the transport path sandwiching the toner cartridge in the up and down direction can be formed. Therefore, the radius of curvature at the U-turn point of the transport path can be increased, whereby reliable transport of the recording medium can achieved while jams are suppressed.

Further, since the projecting member forms a part of the transport path at the first position, the projecting member can serves also as a part of the components forming the transport path. Thus, as compared with the case where the transport path is formed by a separate component, the number of components forming the transport path can be reduced, whereby the size of the image forming apparatus can be reduced.

Further, since the projecting member can take the first position and the second position by pivoting the toner cartridge around the central axis, the toner cartridge can be easily replaced.

Further, when the projecting member takes the first position, the transport path is completed. Thus, reliable and smooth transport of the recording medium along the transport path can be achieved.

On the other hand, when the projecting member takes the second position for intersecting the transport path, the transport path is not completed. Thus, transport of the recording medium can be reliably prevented.

Thus, a reliable transport of the recording medium can be achieved.

Further, at the position for forming a part of the transport path, the projecting member preferably includes space keeping members projecting in a thickness direction of the transported recording medium from both end portions of the projecting member in a direction orthogonal to a transporting direction of the recording medium.

According to such a structure, the space keeping members secure a space in the thickness direction of the transported recording medium at the position of the projecting member for forming a part of the transport path.

Therefore, since the recording medium can pass this space, smooth transport of the recording medium can be achieved. Further, when the toner cartridge is not sufficiently pivoted and the projecting member is thus displaced from the first position, the displacement can be corrected by pressing the space keeping members.

Further, the projecting member preferably includes a plurality of ribs arranged in the transporting direction of the recording medium between the space keeping members and projecting in the thickness direction of the transported recording medium to a smaller extent than the space keeping members.

According to such a structure, when the recording medium is transported, the friction can be reduced by the ribs. Moreover, since the ribs project in the thickness direction of the transported recording medium to a smaller extent than the space keeping members, a space can be secured between the space keeping members and the ribs in the projecting direction. Thus, the recording medium can be reliably transported along the ribs.

Further, a toner cartridge of the present embodiment, is detachably mountable to an image forming apparatus, includes: a toner casing accommodating a developing agent; an opening/closing member which opens/closes an opening formed in the toner casing to discharge the developing agent; and an operation member which operates the opening/closing member, and the operation member can move between an open position for operating the opening/closing member to open the opening, and a close position for operating the opening/closing member to close the opening, and the operation member forms a part of a transport path of a recording medium in the image forming apparatus at the open position in a state where the toner cartridge is mounted in the image forming apparatus.

According to such a structure, the transport path sandwiching the toner cartridge in the up and down direction can be formed in the image forming apparatus. Therefore, the radius of curvature at the U-turn point of the transport path can be increased, whereby reliable transport of the recording medium can achieved while jams are suppressed.

Further, since the operation member forms a part of the transport path at the open position, the operation member can serves also as apart of the components forming the transport path. Thus, as compared with a case where a transport path is formed by a separate component, the number of components forming the transport path can be reduced, whereby the size of the image forming apparatus can be reduced.

Further, the toner cartridge can be easily replaced by operating the operation member.

When the operation member takes the open position, the inside of the toner casing accommodating the developing agent is communicated with the outside through the opened opening, and at the same time, the transport path of the recording medium is brought into completion by the operation member. Thus, a reliable ejection of the developing agent from the opening and a reliable transport of the recording medium can be achieved.

On the other hand, when the operation member takes the close position, the opening is closed by the opening/closing member, and at the same time, the transport path of the recording medium is not completed. Thus, the transport of the recording medium and the ejection of the developing agent can be reliably prevented.

Thus, operation reliability of the image forming apparatus can be further improved.

Further, preferably, the operation member takes a first position along the transport path of the recording medium when the operation member is at the open position, and the operation member takes a second position intersecting the transport path when the operation member is at the close position.

According to such a structure, the operation member takes the first position along the transport path to form a part of it when the operation member is at the open position. Thus, the transport path is completed, and reliable and smooth transport of the recording medium along the transport path can be achieved.

On the other hand, the operation member takes the second position intersecting the transport path when the operation member is at the close position. Thus, the transport path is not completed, and transport of the recording medium can be reliably prevented.

As a result, the completion of the transport path and the opening of the opening can be synchronized with each other to ensure a reliable image forming. Further, the incompletion of the transport path and the closing of the opening can be synchronized with each other to provide a reliable attachment and detachment of the toner cartridge. Thus, operation reliability of the image forming apparatus can be further improved.

Further, when the operation member is at the open position, the operation member preferably forms a part of the transport path, at a position opposed to a main body opening/closing member of the image forming apparatus which is opened/closed when the toner cartridge is attached/detached to/from the image forming apparatus.

According to such a structure, the operation member forms a part of the transport path at the position opposed to the main body opening/closing member. Therefore, when the transported recording medium is jammed in the transport path, this recording medium can be exposed by opening the main body opening/closing member. Thus, the jammed recording medium can be easily removed.

Further, the operation member is exposed by opening the main body opening/closing member. Therefore, when the toner cartridge is detached from the image forming apparatus, the toner cartridge can be easily removed.

As a result, easy jam treatment and easy replacement of the toner cartridge can be achieved.

Further, at the position for forming a part of the transport path, the operation member preferably includes space keeping members projecting in a thickness direction of the transported recording medium from both end portions of the operation member in a direction orthogonal to a transporting direction of the recording medium.

According to such a structure, the space keeping members secure a space in the thickness direction of the transported recording medium at the position of the operation member for forming a part of the transport path.

Therefore, since the recording medium can pass this space, smooth transport of the recording medium can be achieved. Further, when the operation member is not sufficiently operated and is thus slightly displaced from the open position, the displacement of the operation member can be corrected by pressing the space keeping members.

Further, the operation member preferably includes a plurality of ribs arranged in the transporting direction of the recording medium between the space keeping members and projecting in the thickness direction of the transported recording medium to a smaller extent than the space keeping members.

According to such a structure, when the recording medium is transported, the friction can be reduced by the ribs. Moreover, since the ribs project in the thickness direction of the transported recording medium to a smaller extent than the space keeping members, a space can be secured between the space keeping members and the ribs in the projecting direction. Thus, the recording medium can be reliably transported along the ribs.

Further, the operation member also serves as a gripped portion which is gripped when the toner cartridge is attached/detached to/from the image forming apparatus.

According to such a structure, the toner cartridge is easily attached/detached to/from the image forming apparatus by gripping the gripped portion.

As a result, the toner cartridge can be easily replaced.

Further, a toner cartridge according to the other embodiment of the present invention, is detachably mountable to an image forming apparatus, includes: a cylindrical casing accommodating a developing agent; and a projecting member formed on an outer periphery of the casing, and the toner cartridge is pivotable around a central axis of the casing in a state where the toner cartridge is mounted in the image forming apparatus, and the projecting member takes a first position along a transport path of a recording medium in the image forming apparatus and a second position intersecting the transport path when the toner cartridge is pivoted around the central axis, and the projecting member forms a part of the transport path at the first position.

According to such a structure, the transport path sandwiching the toner cartridge in the up and down direction can be formed. Therefore, the radius of curvature at the U-turn point of the transport path can be increased, whereby reliable transport of the recording medium can achieved while jams are suppressed.

Further, since the projecting member forms a part of the transport path at the first position, the projecting member can serves also as apart of the components forming the transport path. Thus, as compared with the case where the transport path is formed by a separate component, the number of components forming the transport path can be reduced, whereby the size of the image forming apparatus can be reduced.

Further, since the projecting member can take the first position and the second position by pivoting the toner cartridge around the central axis, the toner cartridge can be easily replaced.

Further, when the projecting member takes the first position, the transport path is completed. Thus, reliable and smooth transport of the recording medium along the transport path can be achieved.

On the other hand, when the projecting member takes the second position for intersecting the transport path, the transport path is not completed. Thus, transport of the recording medium can be reliably prevented.

Thus, a reliable transport of the recording medium can be achieved.

Further, at the position for forming a part of the transport path, the projecting member preferably includes space keeping members projecting in a thickness direction of the transported recording medium from both end portions of the projecting member in a direction orthogonal to a transporting direction of the recording medium.

According to such a structure, the space keeping members secure a space in the thickness direction of the transported recording medium at the position of the projecting member for forming a part of the transport path.

Therefore, since the recording medium can pass this space, smooth transport of the recording medium can be achieved. Further, when the toner cartridge is not sufficiently pivoted and the projecting member is thus displaced from the first position, the displacement can be corrected by pressing the space keeping members.

Further, the projecting member preferably includes a plurality of ribs arranged in the transporting direction of the recording medium between the space keeping members and projecting in the thickness direction of the transported recording medium to a smaller extent than the space keeping members.

According to such a structure, when the recording medium is transported, the friction can be reduced by the ribs. Moreover, since the ribs project in the thickness direction of the transported recording medium to a smaller extent than the space keeping members, a space can be secured between the space keeping members and the ribs in the projecting direction. Thus, the recording medium can be reliably transported along the ribs.

Further, a toner cartridge according to the other embodiment of the present invention, is detachably mountable to an image forming apparatus, includes: a cylindrical casing accommodating a developing agent; and a projecting member formed on an outer periphery of the casing, and the projecting member includes a sheet guide surface extending in a tangential direction of the outer periphery of the casing, and a part of the outer periphery of the casing and the sheet guide surface form a part of a transport path of a recording medium in a state where the toner cartridge is mounted in the image forming apparatus.

According to such a structure, the transport path sandwiching the toner cartridge in the up and down direction can be formed. Therefore, the radius of curvature at the U-turn point of the transport path can be increased, whereby reliable transport of the recording medium can achieved while jams are suppressed.

Further, a part of the outer periphery of the casing and the sheet guide surface provided on the projecting member, form a part of the transport path in the image forming apparatus in a state where the toner cartridge is mounted in the image forming apparatus, and thus can serve also as a part of the components forming the transport path. As a result, as compared with the case where the transport path is formed by a separate component, the number of components forming the transport path can be reduced, whereby the size of the image forming apparatus can be reduced.

In the following, the best modes of the present invention will be described.

1. Overall Structure of Laser Printer

Figure 2:
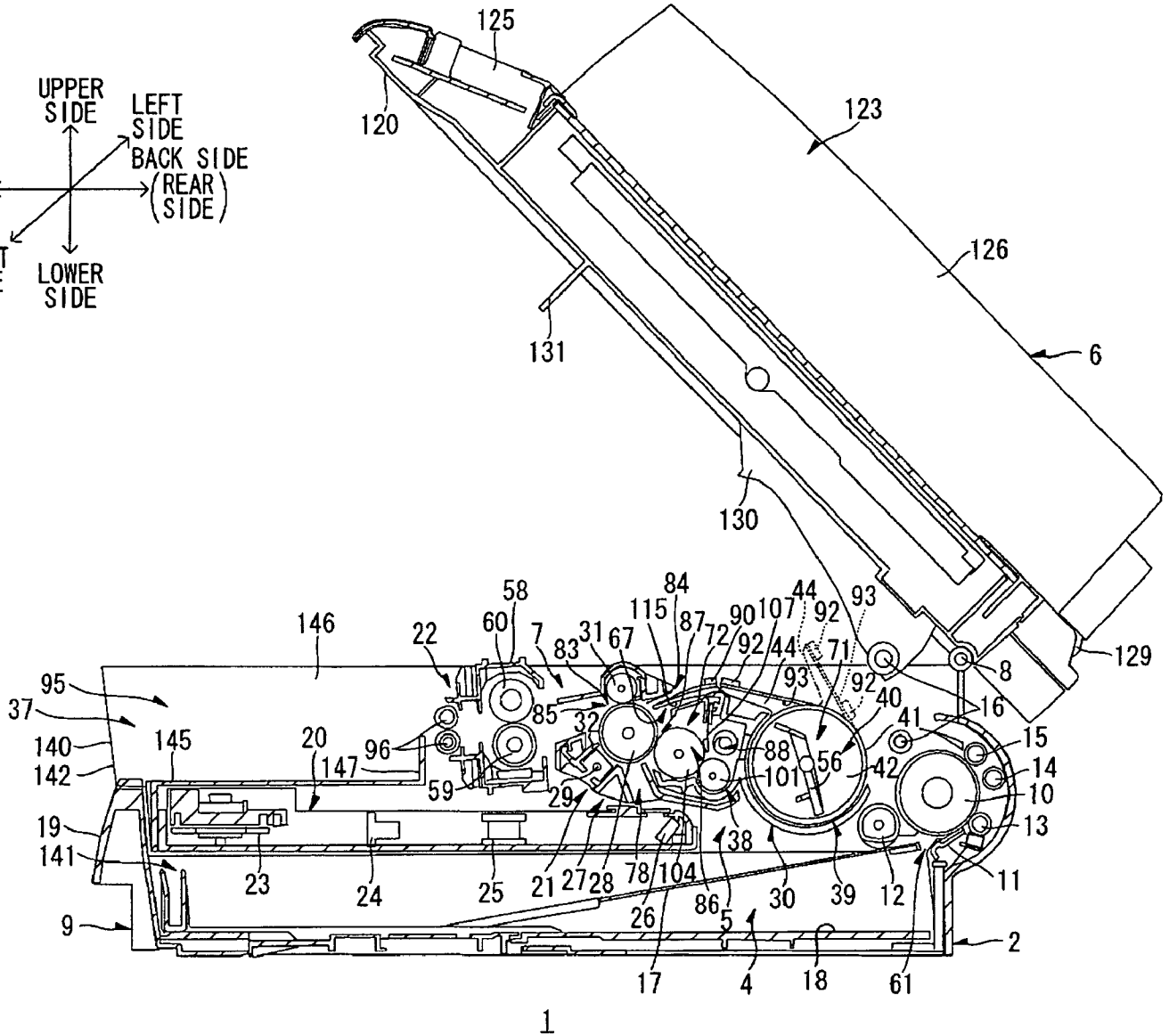
FIG. 2 is a corresponding view to FIG. 1, showing the state of the flat bed unit bed being in an spaced position.

FIGS. 1 and 2 are side sectional views of a principal part of a laser printer as an embodiment of an image forming apparatus including a toner cartridge of the present invention. FIG. 1 shows the state of a flat bed unit as the main body opening/closing member described later, being in a close position, and FIG. 2 shows the state of the flat bed unit being in an spaced position.

The laser printer 1 includes a main body casing 2, a feeder section 4, housed in the main body casing 2, for feeding sheet 3 (recording medium), an image forming section 5 for forming an image on the fed sheet 3, an ejection section 37 formed in the main body casing 2, and a flat bed unit 6, provided over the main body casing 2, for scanning the image on a document.

In the following description, it is to be noted that the sheet left side of FIG. 1 is defined as the front (fore) side and a sheet right side of FIG. 1 is defined as a back (rear) side in the state where a toner cartridge 40 and a process cartridge 21 as described later, are mounted in the main body casing 2. Further, in the sheet thickness direction of FIG. 1, the near side of FIG. 1 is defined as the right side, and the far side of FIG. 1 is defined as the left side.

(1) Main Body Casing

As shown in FIG. 1, main body casing 2 is formed in a box shape having a generally L-shaped section as viewed from side elevation. A mounting port 7 is formed in a top wall of the main body casing 2. A toner cartridge 40 and a process cartridge 21 described later where the toner cartridge 40 is removably mounted, are mounted and dismounted through the mounting port 7 individually or unitarily. The flat bed unit 6 is mounted so as to open and close the mounting port 7. The flat bed unit 6 is swingably supported by a pivot shaft 8 inserted through a rear end portion thereof along a widthwise direction (a transverse direction).

When the flat bed unit 6 is closed by being swung about the pivot shaft 8 to its close position where a front end portion is positioned close to an upper end portion of the main body casing 2, the mounting port 7 is closed by the flat bed unit 6. As shown in FIG. 2, when the flat bed in it 6 is opened by being swung about the pivot shaft 8 to its spaced position where the front end portion of the flat bed unit 6 is away from the upper end portion of the main body casing 2, the mounting port 7 is opened widely to the front. Therefore, the toner cartridge 40 and the process cartridge 21 can be mounted in and dismounted from the main body casing 2 through the mounting port 7 from the front side.

As shown in FIG. 1, a front side wall 140 is formed in an upper half of main body casing 2 the front side of main body casing 2, while a sheet feed tray mounting port 141 is formed in a lower half of the front side of the main body casing 2. The sheet feed tray mounting port 141 is formed in a rectangular shape which is elongated in width direction. A sheet feed tray 9 described later can be mounted in and dismounted from the main body casing 2 through the sheet feed tray mounting port 141 along the anteroposterior direction.

(2) Feeder Section

The feeder section 4 is provided at the bottom of the main body casing 2, including the sheet feed tray 9 removably mounted and dismounted along the anteroposterior direction, a separation roller 10 and a separation pad 11 provided above a rear end portion of the sheet feed tray 9, and a sheet feed roller 12 provided in front of the separation roller 10 (on an upstream side of the sheet transporting direction, toward the separation pad 11).

The sheet feed tray 9 is formed in a box shape, has an opening at the top thereof, and integrally has a grip 19 on the front side thereof. The grip 19 is formed in an inverted L-shape in section as viewed from side elevation, whose base end portion is connected to an upper end portion of on the front side of the sheet feed tray 9, and whose distal end portion is extended downwardly to a generally vertical center position of the sheet feed tray 9. The grip 19 covers an upper half of the front side of the sheet feed tray 9.

The feeder section 4 includes a sheet powder dust removing roller 13 disposed opposite to the separation roller 10 and located above a rear end of the separation pad 11, a first guide roller 14 and a second guide roller 15 which are disposed opposite to the separation roller 10 on the downstream side toward the sheet dust removing roller 13 with respect to a sheet transporting direction. The first guide roller 14 is disposed on the upstream side toward the second guide roller 15 with respect to the sheet transporting direction. The second guide roller 15 is disposed in abutment with the separation roller 10, while the first guide roller 14 is spaced apart from the separation roller 10.

Registration rollers 16 including a pair of rollers are provided above and in front of the separation roller 10.

The sheet feed tray 9 is provided, in an interior thereof, with a sheet pressing plate 17 for allowing sheet 3 to be stacked. The sheet pressing plate 17 is swingably supported at a front end portion thereof so that it can be swung between a sheet stacked position where the sheet pressing plate 17 is extended along a bottom plate 18 of the sheet feed tray 9 and its rear end portion is lowered, and a sheet feeding position where the sheet pressing plate 17 is positioned obliquely and its rear end portion is heightened. When the sheet feed tray 9 is dismounted from the main body casing 2 through the sheet feed tray mounting port 141, the rear end portion of the sheet pressing plate 17 moves downwardly under its own weight, so that the sheet pressing plate 17 is put in the sheet stacked position. When the sheet pressing plate 17 is positioned in the sheet stacked position, the sheet 3 can be stacked on the sheet pressing plate 17.

The sheet feed tray 9 is provided with a lever (not shown) for lifting up the rear end portion of the sheet pressing plate 17. The lever (not shown) works to swing the sheet pressing plate 17 between the sheet stacked position and the sheet feeding position.

When the lever (not shown) is operated to put the sheet pressing plate 17 in the sheet feeding position, the sheet 3 stacked on the sheet pressing plate 17 is pressed against the sheet feed roller 12, and sheet feeding toward a separation position between the separation roller 10 and the separation pad 11, is started by rotation of the sheet feed roller 12.

The sheet 3 fed toward the separation position by the sheet feed roller 12 is sandwiched between the separation roller 10 and the separation pad 11 by the rotation of the separation roller 10, then separated one by one. The sheet 3 fed passes through between the sheet dust removing roller 13 and the separation roller 10, where the sheet dust is removed from the sheet 3. Thereafter, the sheet 3 is guided by the first guide roller 14 and the second guide roller 15 and is turned around forward in a generally U-shape, then is carried toward the registration rollers 16.

As described before, the first guide roller 14 is disposed opposite to and spaced apart from the separation roller 10 at a generally U-shaped turn-around position (at the deepest portion in the U-shape or at the backmost portion in FIG. 1). Therefore, even when the sheet 3's downstream side end portion with respect to the transporting direction passing over the sheet dust removing roller 13, is carried so as to go off the outer periphery of the separation roller 10, without curving around it, the sheet transporting direction is corrected by the first guide roller 14 so that the downstream side end portion of sheet 3 can be correctly carried around the separation roller 10.

The registration rollers 16 resist the sheet 3, then carry the sheet 3 to a transfer position between a photosensitive drum 28 (image carrier) and a transfer roller 31 as described later. A toner image on the photosensitive drum 28 is transferred on the sheet 3 at the transfer position.

(3) Image Forming Section

An image forming section 5 includes a scanner 20, a process cartridge 21, and a fixation unit 22.

(a) Scanner

The scanner 20 is arranged above the feeder section 4 in the main body casing 2. The scanner 20 is placed adjacent to the sheet feed tray 9 so that the scanner 20 can overlap upwardly with the sheet feed tray 9 about an area extending from a front end thereof to a portion which is slightly rear toward a center thereof in anteroposterior direction. And the scanner 20 is placed adjacent to a sheet ejection tray 95 described later so that the front half portion of the scanner 20 can overlap downwardly with the sheet ejection tray 95. The scanner 20 includes a laser source (not shown), a polygonal mirror 23 to be rotationally driven, an fθ lens 24, a lens 25, and a reflector 26, along the front and rear direction. As indicated by a chain line, the laser beam emitted from the laser source based on the image data, is polarized by the polygonal mirror 23 at first, and then passes through the fθ lens 24 and the lens 25 in the order, next a light path of the laser beam is folded obliquely forward and upward by the reflector 26, to irradiate a surface of the photosensitive drum 28 of the process cartridge 21 with the laser beam.

(b) Process Cartridge

Figure 3:
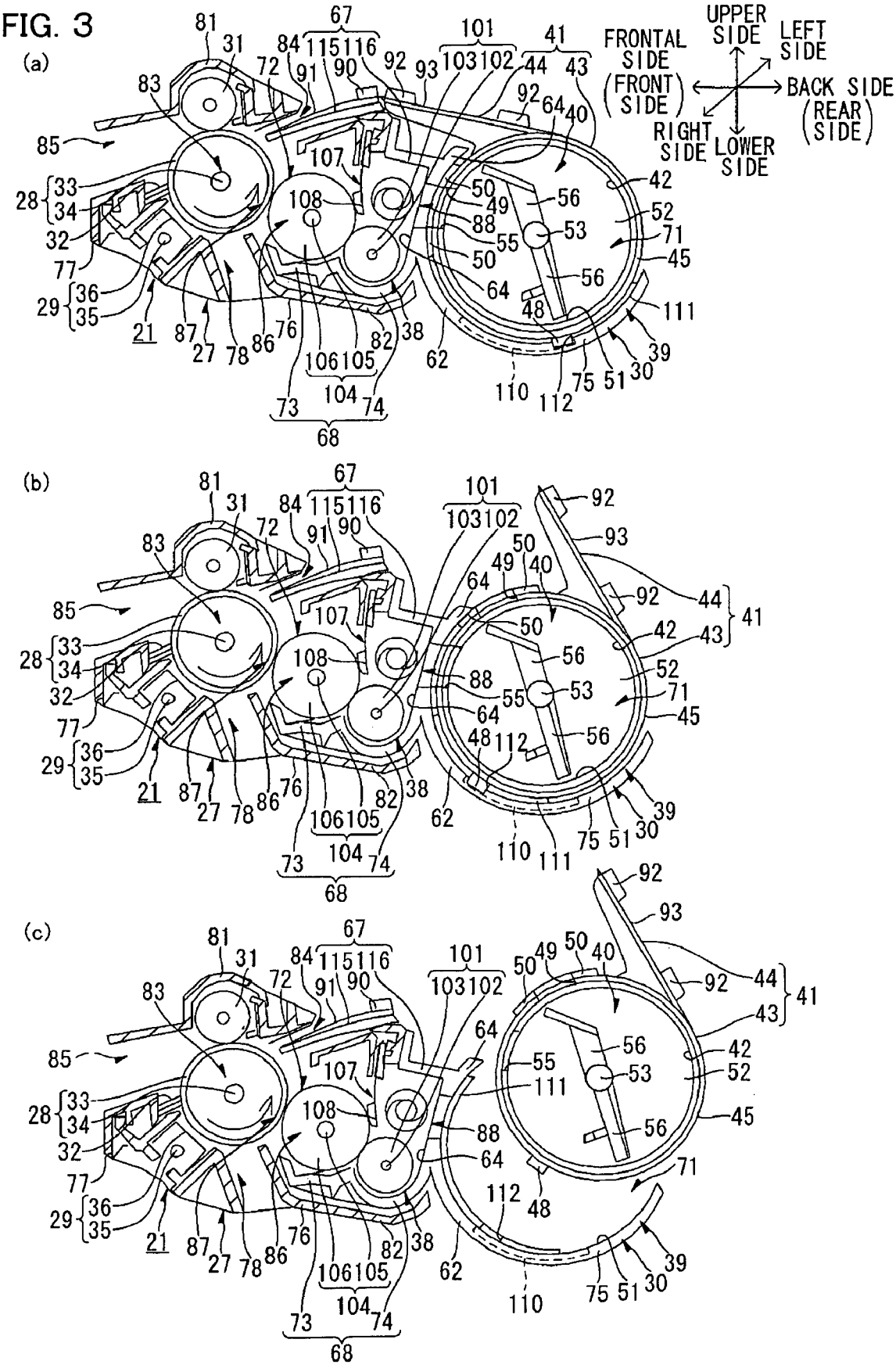
FIGS. 3(*a*) to 3(*c*) are operation diagrams for explaining the operation of mounting/dismounting a toner cartridge in/from a developing unit of a process cartridge.

FIGS. 3 (*a*) to 3 (*c*) are side sectioned views of a principal part of the process cartridge of the laser printer shown in FIG. 1, and FIGS. 3(*a*) to 3(*c*) show the mounting/dismounting of the toner cartridge in/from the developing unit of the process cartridge.

Figure 4:
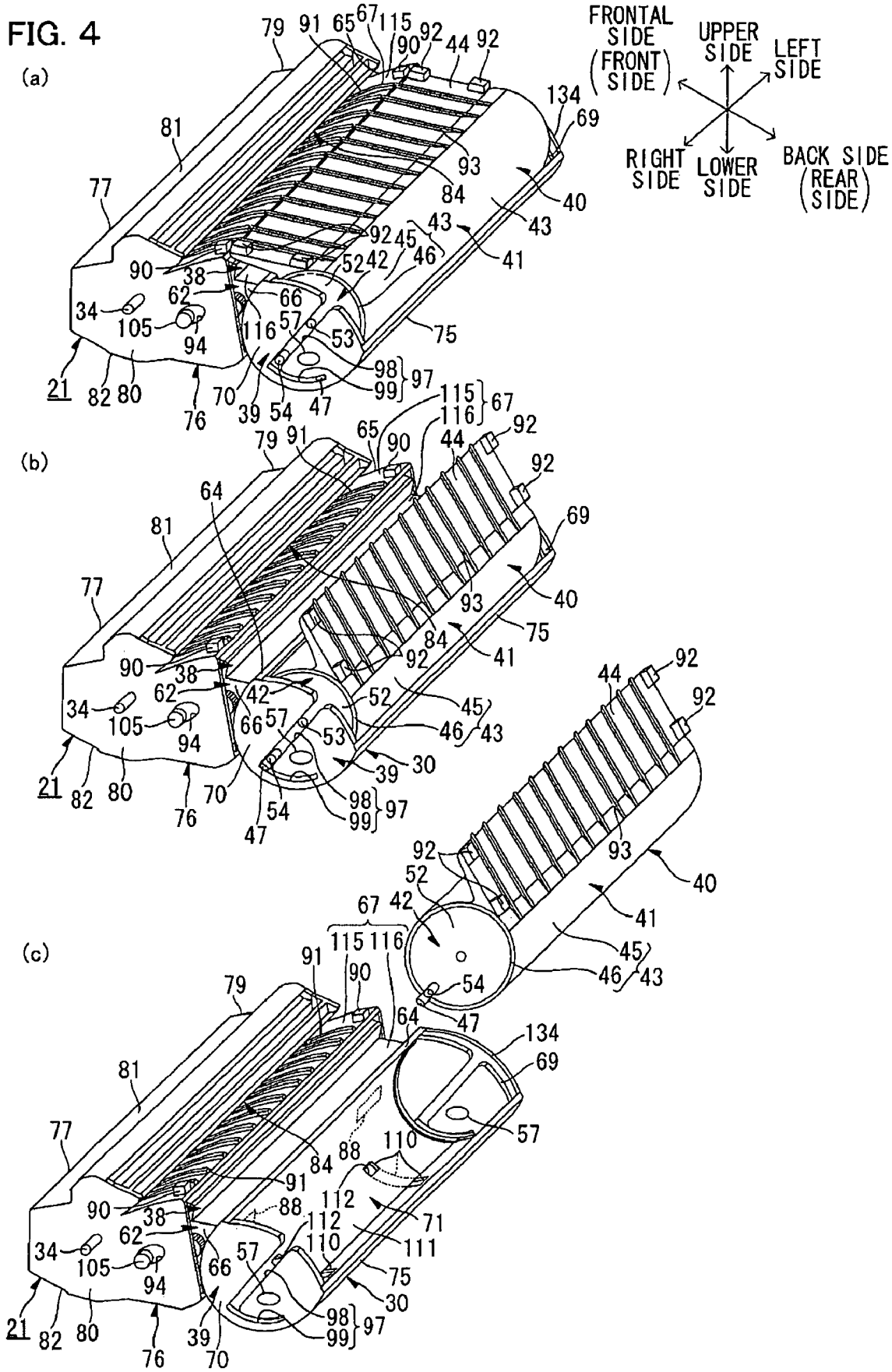
FIGS. 4 (*a*) to 4(*c*) are operation diagrams, corresponding to FIGS. 3(*a*)-3(*c*), for explaining the operation of mounting/dismounting the toner cartridge in/from the developing unit of the process cartridge.

FIGS. 4 (*a*) to 4(*c*) are right-side perspective views of the process cartridge of the laser printer shown in FIG. 1 as viewed from above and behind, and FIGS. 4(*a*) to 4(*c*) correspond to FIGS. 3(*a*) to 3(*c*), show the mounting/dismounting of the toner cartridge in/from the developing unit of the process cartridge.

Figure 5:
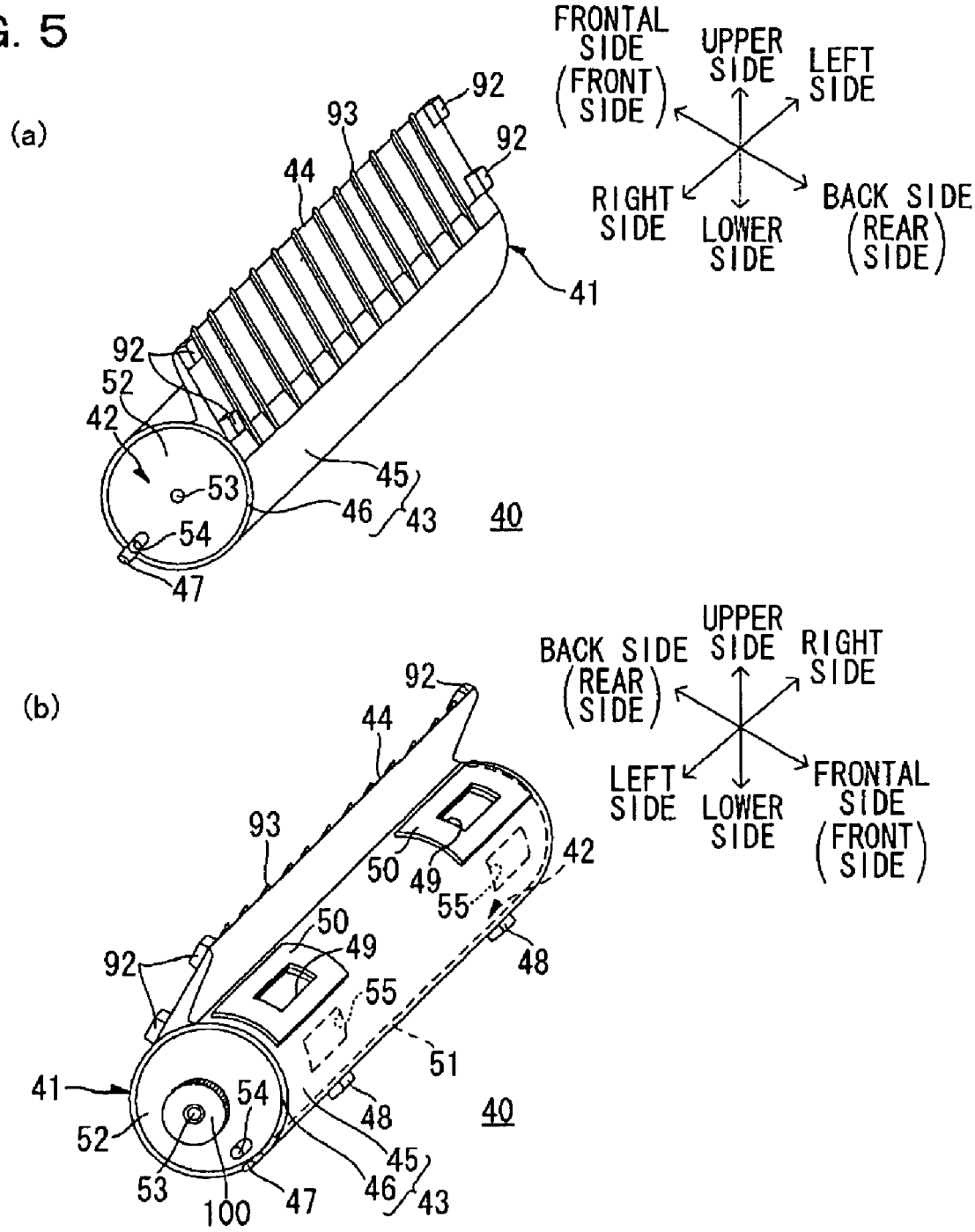
FIG. 5 (*b*) is a left-side perspective view of the toner cartridge, as viewed from above and front, with its outer housing being in the toner close position.

FIG. 5(*a*) is a right-side perspective view of the toner cartridge, as viewed from above and behind, with its outer housing being in the toner close position described later, and FIG. 5(*b*) is a left-side perspective view of the toner cartridge, as viewed from above and front, with its outer housing being in the toner close position.

Figure 6:
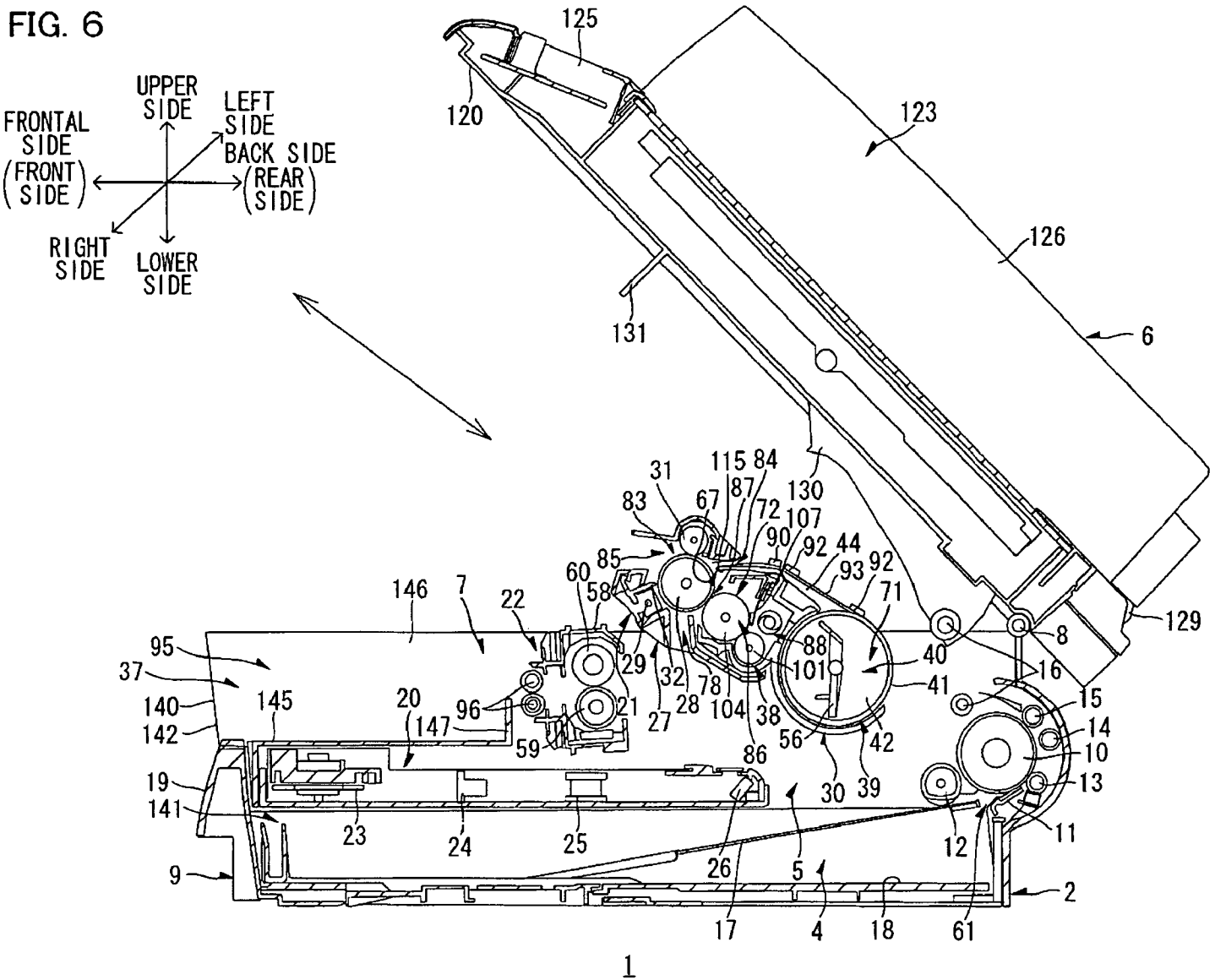
FIG. 6, corresponds to FIG. 2, and shows the state of the process cartridge being mounted/dismounted in/from the laser printer.

FIG. 6 corresponds to FIG. 2, and shows the state of the process cartridge being mounted/dismounted in/from the laser printer.

As shown in FIG. 1, the process cartridge 21 is arranged adjacent to the scanner 20 in the main body casing 2 so that its front half portion can overlap upwardly with the scanner 20, and arranged adjacent to the sheet feed tray 9 so that its rear half portion can overlap upwardly with the sheet feed tray 9.

As shown in FIG. 6, the process cartridge 21 is removably mounted in the main body casing 2. As shown with the allow in FIG. 6 the direction of the process cartridge 21 being mounted in the main body casing 2 (the mounting direction) corresponds to an obliquely backward and downward direction, and the direction of the process cartridge 21 being dismounted from the main body casing 2 (the dismounting direction) corresponds to an obliquely forward and upward direction.

As shown in FIGS. 3(*a*) to 3(*c*), the process cartridge 21 includes a drum unit 27 and a developing unit 30 unitarily as a developing unit and further includes a toner cartridge 40 removably mounted in the process cartridge 21.

(b-1) Drum Unit

The drum unit 27 includes a drum housing 76, the photosensitive drum 28, a scorotron charger 29, a transfer roller 31, and a cleaning brush 32 provided in the drum housing 76.

The drum housing 76 is formed in a box shape elongated in a widthwise direction and has an opening at a rear side thereof, the drum housing 76 integrally includes a drum front wall 77, a drum left side wall 79 (see FIGS. 4 (*a*) to 4 (*c*)), a drum right side wall 80 (see FIGS. 4(*a*) to 4 (*c*)), a drum top wall 81, and a drum bottom wall 82.

As shown in FIGS. 4 (*a*) to 4 (*c*), the drum left side wall 79 and the drum right side wall 80 are disposed opposite to and spaced apart from each other in the widthwise direction. Each of the drum left side wall 79 and the drum right side wall 80 has an elliptical hole 94 which is elliptical as viewed from side elevation and formed at the position which is slightly rear from the center position thereof in anteroposterior direction and at the vertical center position thereof.

The drum bottom wall 82 is extended between a lower edge of the drum left side wall 79 and a lower edge of the drum right side wall 80. The drum front wall 77 is extended between a front edge of the drum left side wall 79 and a front edge of the drum right side wall 80. The drum top wall 81 is extended between an upper edge of the drum left side wall 79 and an upper edge of the drum right side wall 80.

As shown in FIGS. 3 (*a*) to 3 (*c*), the drum bottom wall 82 has a laser entrance 78, formed midway in anteroposterior direction, for irradiating the photosensitive drum 28 with the laser beam emitted from the scanner 20. A first passing port 84 is opened between a rear edge of the drum top wall 81 and a front edge of a development top wall 67 of the developing unit 30 described later, and a second passing port 85 is opened at an upper end of the drum front wall 77. The first passing port 84 and the second passing port 85 are both formed in a widthwise elongated rectangular shape.

In the drum housing 76, a zone defined by the drum front wall 77, and the front halves of the drum left side wall 79 and, drum right side wall 80 and drum bottom wall 82, serves as a drum accommodating section 83 for accommodating the photosensitive drum 28, the scorotron charger 29, the transfer roller 31. and the cleaning brush 32. The drum accommodating section 83 is formed in a cylindrical shape opened at the front and rear sides.

A zone defined by the rear halves of the drum left side wall 79, drum right side wall 80, and drum bottom wall 82, serves as a development placing section 86 for the developing unit 30 to be placed therein. The development placing section 86 is formed in an U-shaped closed-end frame opened at the top, as viewed in section from the front side.

The drum accommodating section 83 and the development placing section 86 communicate with each other.

The photosensitive drum 28 includes in a cylindrical shaped, a drum body 33 whose outermost surface layer is formed by a positive chargeable photosensitive layer of polycarbonate and the like, and a metal drum shaft 34 arranged in an axis of the drum body 33 and extending along an axial direction of the drum body 33. The drum shaft 34 is supported at both axial ends thereof between the drum left side wall 79 and the drum right side wall 80 of the drum housing 76 (see. FIGS. 4 (*a*) to 4 (*c*)), and the drum body 33 is supported rotatably relative to the drum shaft 34. Therefore, the photosensitive drum 28 is incorporated in the drum housing 76 so that it can freely rotate around the drum shaft 34. The photosensitive drum 28 is rotationally driven by a driving force input from a motor (not shown).

The scorotron charger 29 is supported on the drum bottom wall 82 of the drum housing 76 at the obliquely forward and downward of the photosensitive drum 28 and is disposed opposite to and spaced apart from the photosensitive drum 28 not to contact therewith. The scorotron charger 29 includes a discharge wire 35 disposed opposite to and spaced apart from the photosensitive drum 28, and a grid 36, disposed between the discharge wire 35 and the photosensitive drum 28, for controlling quantity of electric charge from the discharge wire 35 to the photosensitive drum 28.

In the scorotron charger 29, a bias voltage is applied to the grid 36, while at the same time, a high voltage is applied to the discharge wire 35, whereby corona discharge is generated from the discharge wire 35 to allow a surface of the photosensitive drum 28 to be uniformly charged positively.

The transfer roller 31 in the drum housing 76 is disposed above and vertically opposite to the photosensitive drum 28 and is put in contact with the photosensitive drum 28 to form a nip between the transfer roller 31 and the photosensitive drum 28. This nip forms a transfer position between the photosensitive drum 28 and the transfer roller 31.

The transfer roller 31 includes a metal roller shaft supported rotatably between the drum left side wall 79 and the drum right side wall 80 of the drum housing 76, and a rubber roller of conductive rubber material for covering the metal roller shaft. In the transfer, a transfer bias is applied to the transfer roller 31. The transfer roller 31 is rotationally driven by a driving force input from a motor (not shown).

The cleaning brush 32 is disposed on the drum front wall 77 of the drum housing 76. The cleaning brush 32 opposes to and contacts with the photosensitive drum 28 at a location on the obliquely forward and downward side of the photosensitive drum 28 and on the obliquely forward and upward side of the scorotron charger 29 (on the upstream side from the scorotron charger 29 with respect to the rotational direction of the photosensitive drum 28 (see an arrow of FIGS. 3 (*a*) to 3(*c*)).

(b-2) Developing Unit

The developing unit 30 is provided integrally with the drum unit 27 in the development placing section 86 of the drum housing 76.

The developing unit 30 includes a development housing 62, a feed roller 101, a developer roller 104, and a layer-thickness regulating blade 107 which are arranged in the development housing 62.

The development housing 62 integrally includes a front housing 38 formed in a widthwise elongated box shape opened at the front side, and a rear housing 39 formed in a cylindrical shape opened at the top.

The front housing 38 integrally includes a development rear wall 64, a development left side wall 65 (see FIGS. 4 (*a*) to 4 (*c*)), a development right side wall 66 (See FIGS. 4 (*a*) to 4 (*c*)), a development top wall 67, and a development bottom wall 68.

The development left side wall 65 and the development right side wall 66 are formed in a generally rectangular shape, as viewed from side elevation, and are disposed opposite to and spaced from each other in the widthwise direction.

The development bottom wall 68 is extended between a lower edge of the development left side wall 65 and a lower edge of the development right side wall 66 and integrally includes a first bottom wall 73 and a second bottom wall 74 which are arranged in this order from the front to the rear.

The first bottom wall 73 is located in the front side of the development bottom wall 68 and is formed in a generally rectangular shape as viewed from top, extending from the rear to the front in a generally hook shape in section as viewed from side elevation.

The second bottom wall 74 extends continuously from a rear edge of the first bottom wall 73 and is formed in a generally semicircular arc shape in section, as viewed from side elevation, along the feed roller 101.

The development top wall 67 is extended between an upper edge of the development left side wall 65 and an upper edge of the development right side wall 66 and integrally includes a first top wall 115 and a second top wall 116.

The first top wall 115 is located in the front side of the development top wall 67 and is extended obliquely rearwards to the rear side.

The sheet 3 passes over the development top wall 67. As shown in FIGS. 4 (*a*) to 4 (*c*), the first top wall 115 has first guide lugs 90 on the rear side of an upper surface facing the carried sheet 3 at both widthwise ends, respectively. The first guide lugs 90 are formed in a generally rectangular parallelepiped shape and project in a thickness direction of the sheet 3, or to an upward direction.

There are provided a plurality of first guide ribs 91 equally spaced along the widthwise direction between the two guide lugs 90 opposing each other in the widthwise direction. The first guide rids 91 are ridges projecting upward and extending along the anteroposterior direction, or the sheet transporting direction.

The first guide lugs 90 project from the upper surface of the first top wall 115 to a larger extent than the first guide ribs 91, and the difference is larger than a thickness of the sheet 3.

As shown in FIGS. 3 (*a*) to 3 (*c*), the second top wall 116 is formed in a generally L-shape in section, as viewed from right side, extending downward from a rear edge of the first top wall 115, then bending, and extending rearward, and then connected to an upper edge of the development rear wall 64.

The development rear wall 64 is extended between a rear edge of the development left side wall 65 and a rear edge of the development right side wall 66. A lower edge end of the development rear wall 64 is connected to a rear edge of the second bottom wall 74.

An insertion opening 87 formed on the front side of the front housing 38 is defined by front edges of the development top wall 67, the development left side wall 65, the development right side wall 66, and the development bottom wall 68. The insertion opening 87 is formed in a widthwise elongated rectangular shape.

The rear housing 39 is integrally formed by a left side wall 69, a right side wall 70, and a curved wall 75.

As shown in FIG. 4(*c*), the left side wall 69 and the right side wall 70 are disposed opposite to each other in the widthwise direction and are formed in a generally gibbous moon shape as viewed from side elevation.

The left side wall 69 and the right side wall 70 respectively have guide grooves 97 formed to penetrate the left side wall 69 and the right side wall 70 in the thickness direction. Each guide groove 97 is formed in a sickle-like shape in section, as viewed from side elevation, integrally including a linear groove portion 98 extending obliquely forward and downward from an upper edge of the left side wall 69 and the right side wall 70 at an anteroposterior center thereof respectively, and a curved groove portion 99 extending continuously rearward from a lower end of the linear groove portion 98 along a periphery of the curved wall 75.

A plate 134, having the same shape as the left side wall 69 as viewed from side elevation, is provided on the left side of the left side wall 69 at an widthwise spaced location. No guide groove 97 is formed in this plate 134.

The curved wall 75 is extended between the left side wall 69 and the right side wall 70 around their outer peripheries except their upper edges and is formed in a generally semicircular arc shape in section as viewed from side elevation. The curved wall 75 has a pair of circumferential grooves 110 formed in an upper surface thereof at locations inwardly about one-quarter of a widthwise dimension of the curved wall 75 from both widthwise ends thereof. The circumferential grooves 110 are concaved in a region extending from a position midway between an anteroposterior center and a front end of the curved wall 75 to a position midway between that center and a rear end thereof, and extend along a circumferential direction of the curved wall 75. The circumferential grooves 110 are formed in a rectangular shape as viewed from top.

As shown in FIGS. 3 (*a*) to 3 (*c*), in the front housing 38, a zone defined by the development rear wall 64, the development left side wall 65, the development right side wall 66, the development top wall 67, and the development bottom wall 68 serves as a developing chamber 72 for housing the feed roller 101, the developer roller 104, and the layer-thickness regulating blade 107.

In the rear housing 39, a zone defined by the left side wall 69, the right side wall 70, and the curved wall 75 serves as a toner cartridge accommodation chamber 71 for accommodating the toner cartridge 40. The toner cartridge accommodation chamber 71 is formed in a closed-end frame shape opened at the top.

The front housing 38 and the rear housing 39 are joined to each other via the rear surface of the development rear wall 64 and the front surface of the curved wall 75. Introduction ports 88 are formed in a joined portion of the development rear wall 64 and the curved wall 75 at both widthwise end portions thereof, and penetrate the joining portion in the thickness direction. The introduction ports 88 are formed in a widthwise elongated rectangular shape. The toner cartridge accommodation chamber 71 and the developing chamber 72 communicate with each other via the introduction ports 88.

The toner cartridge accommodation chamber 71 is provided in an interior thereof with a shutter 111 as an introduction port opening/closing member.

The shutter 111 is formed by a thin plate of generally semicircular arc shape in section, as viewed from side elevation, smaller in circular arc than generally semicircular arc shape of the curved wall 75. As shown in FIGS. 4 (*a*) to 4 (*b*), the shutter 111 has first penetrate holes 112 having a rectangular shape as viewed from top and penetrating the shutter 111 in the thickness direction. The first penetrate holes 112 are formed in a rear portion of the shutter 111 at locations inwardly about one-quarter of a widthwise dimension of the shutter 111 from both widthwise ends thereof.

The shutter 111 is supported on the upper surface of the curved wall 75 in the interior of the toner cartridge accommodation chamber 71 so that it can be freely slid along the generally semicircular arc of the upper surface of the curved wall 75. The first penetrate holes 112 always oppose to the circumferential grooves 110 formed in the curved wall 75, respectively. The shutter 111 is movable between the development close position where the introduction ports 88 are both closed and the development open position where the introduction ports 88 are opened. Differently from the opening and closing mechanism on the toner cartridge side, the shutter 111 must withstand the repeat use. From this viewpoint, the shutter 111 is preferably formed of a thin metal plate, a plated steel plate, alumina or the like.

As shown in FIGS. 3 (*a*) to 3 (*c*), the feed roller 101 is disposed in front of the introduction ports 88. The feed roller 101 includes a feed roller shaft 102 formed of metal, and a sponge roller 103 formed of conductive foam material for covering the feed roller shaft 102. The feed roller shaft 102 is rotatably supported at both axial ends thereof between the development left side wall 65 and the development right side wall 66 at anteroposterior position thereof corresponding to the second bottom wall 74. The feed roller 101 is rotationally driven by a driving force from a motor (not shown) being input to the feed roller shaft 102.

The developer roller 104 is disposed in front of the feed roller 101 in the state where it contacts with the feed roller 101 so that the developer roller 104 and the feed roller 101 can be compressed with each other. The developer roller 104 includes a developer roller shaft 105 formed of metal, and a rubber roller 106 formed of conductive rubber material for covering the developer roller shaft 105.

The developer roller shaft 105 is rotatably supported at both axial ends thereof between the development left side wall 65 and the development right side wall 66 at anteroposterior positions thereof corresponding to the first bottom wall 73. The rubber roller 106 is formed of conductive urethane rubber or silicone rubber including carbon fine particles and is covered with a coating layer formed of resin excellent in wear and abrasion resistance such as urethane rubber containing fluorine or polyimide. The developer roller 104 is rotationally driven by a driving force from a motor (not shown) being input to the developer roller shaft 105. As shown in FIGS. 4 (*a*) to 4 (*c*), in the developing process, developing bias is applied to the developer roller 104 via one widthwise end portion of the developer roller shaft 105 which is exposed via the elliptical holes 94 formed in the drum left side wall 79 and the drum right side wall 80.

As shown in FIGS. 3 (*a*) to 3 (*c*), the layer-thickness regulating blade 107 is provided with a pressing portion 108 of generally semicircular shape in section. The pressing portion 108 is formed of insulative or conductive silicon rubber or urethane rubber and is provided at a distal end of a blade body formed of a metal plate spring material. The blade body of the layer-thickness regulating blade 107 is supported at a base end thereof to the development top wall 67 at a location above the developer roller 104, so that the pressing portion 108 is press-contacted with the developer roller 104 by an elastic force of the blade body.

(b-3) Toner Cartridge

The toner cartridge 40 is removably mounted in the toner cartridge accommodation chamber 71 of the development housing 62. Therefore, the toner cartridge 40 can be mounted in and dismounted from the main body casing 2 by mounting and dismounting the process cartridge 21 in and from the main body casing 2 through the mounting port 7 in the state where the toner cartridge 40 is mounted in the process cartridge 21. Further, the toner cartridge 40 separately can be mounted in and dismounted from the process cartridge 21 mounted in the main body casing 2, through the mounting port 7.

As shown in FIG. 5(*a*), the toner cartridge 40 is formed in a generally inverted 9 shape, as viewed from right side, including an outer housing 41 and an inner housing 42 (toner casing) both of which are formed of semi-transparent resin.

The outer housing 41 is formed in a generally inverted 9 shape, as viewed from right side of the toner cartridge 40, and integrally includes a cylindrical portion 43 (casing), and a guide lever 44 (projecting member and operation member).

The cylindrical portion 43 is in the shape of a widthwise elongated and hollow cylinder, including a cylindrical external wall 45 (opening/closing member), and a pair of ring-shaped outside side walls 46 defined as both widthwise end surfaces of the cylindrical external wall 45 by thickness of the cylindrical external wall 45. Columnar external lugs 47 are respectively formed on the outside side walls 46 at circumferential and widthwise corresponding portions thereof, to project widthwise outward.

The guide lever 44 has a widthwise dimension equal to that of the cylindrical external wall 45 and is in the shape of a widthwise elongated, generally rectangular, flat plate. The guide lever 44 projects tangentially from one circumferential portion of the cylindrical external wall 45. In detail, a base end portion of the guide lever 44 on the cylindrical external wall 45 is positioned on the opposite side to the external lugs 47 on the cylindrical portion 43 with respect to a center axis of the cylindrical portion 43. A distal end portion of the guide lever 44 projects counterclockwise, when the cylindrical portion 43 is viewed from right side.

When sheet 3 is carried in the image forming operation of the laser printer 1, the sheet 3 passes over the upper surface (sheet guide surface) of the guide lever 44 which is the opposite side to the lower surface of the guide lever 44 opposing to the cylindrical external wall 45 of the cylindrical portion 43. Guide lugs 92 (space keeping members) are respectively provided on the upper surface of the guide lever 44 at the both widthwise end portions thereof on the base end portion and on the distal end portion.

The second guide lugs 92 are formed in a generally rectangular parallelepiped shape having the same size as the first guide lugs 90. The second guide lugs 92 extend on the guide lever 44 in a direction away from the cylindrical external wall 45, or in the thickness direction of the sheet 3 passing over the upper surface of the guide lever 44 in the image forming operation.

There are provided a plurality of second guide ribs 93 equally spaced in the widthwise direction between the second guide lugs 92 opposing to each other in the widthwise direction. The second guide lugs 92 are ridges projecting in a direction away from the cylindrical external wall 45 and also extending in a direction from the base end portion toward the distal end portion of the guide lever 44, or along the sheet transporting direction in the image forming operation. The second guide ribs 93 project from the upper surface of the guide lever 44 to equal extent to the first guide ribs 91 projecting from the upper surface of the first top wall 115.

Further, the second guide ribs 93 project from the upper surface of the guide lever 44 to smaller extent than the second guide lugs 92 projecting from the upper surface of the guide lever 44, and the difference there between is larger than the thickness of the sheet 3.

The cylindrical external wall 45 has first radial lugs 48 projecting radially outwardly. The first radial lugs 48 are respectively formed at locations substantially circumferentially corresponding to the position of the external lugs 47 and inwardly about one-quarter of a widthwise dimension of the cylindrical external wall 45 from both widthwise ends thereof, as shown in FIG. 5(*b*).

Also, the cylindrical external wall 45 has first vents 49 penetrating therethrough it in the thickness direction, which are respectively formed in both widthwise end portions of the cylindrical external wall 45 at locations adjacent to the base end portion of the guide lever 44 with respect to the clockwise direction of the cylindrical portion 43 as viewed from left side.

The first vents 49 are formed in a rectangular shape as viewed from radially outside.

Also, the cylindrical external wall 45 has second radial lugs 50 which are formed thereon along edges of the first vents 49 and project radially outwardly. The second radial lugs 50 are formed in a rectangular frame-like shape as viewed from radially outside and are formed of elastic material such as rubber or sponge and the like.

The inner housing 42 is formed in the shape of a widthwise elongated hollow cylinder having a smaller diameter than the cylindrical portion 43 of the outer housing 41, and integrally includes a cylinder-like cylindrical internal wall 51 (see FIGS. 3 (*a*) to 3 (*c*)), and a pair of disc-like inside side walls 52 for closing both widthwise side surfaces of the cylindrical internal wall 51. An agitator rotating shaft 53 is extended between the inside side walls 52 opposing to each other in the widthwise direction, at circle centers thereof, as shown in FIGS. 3 (*a*) to 3 (*c*). The agitator rotating shaft 53 is rotatably supported on the inside side walls 52. An agitator 56 is provided on the agitator rotating shaft 53. As shown in FIG. 5(*b*), the left side portion of the agitator rotating shaft 53 projects outwardly from the left inside side wall 52 in the widthwise direction, and an agitator gear 100 is provided on the projected portion of the agitator rotating shaft 53. The agitator 56 is rotated by a driving force from a motor (not shown) being input to the agitator gear 100 provided on the agitator rotating shaft 53.

The inside side walls 52 have cylinder-like internal lugs 54 provided at locations on the radially outer side from the agitator rotating shaft 53. The internal lugs 54 project outwardly in the widthwise direction and oppose to each other in the widthwise direction.

The cylindrical internal wall 51 has, in a portion of the circumferential surface thereof, second vents 55 (openings) penetrating therethrough it in the thickness direction. The second vents 55 are formed in both widthwise end portions of the cylindrical internal wall 51 thereof. The second vents 55 are formed in a rectangular shape having substantially the same size as the first vents 49 as viewed from radially outside.

The inner housing 42 is fitted in the outer housing 41. Slide packings (not shown) is interposed between the inner housing 42 and the outer housing 41, between both widthwise ends of an outside surface of the cylindrical internal wall 51 and both widthwise ends an inside surface of the cylindrical external wall 45 respectively. Therefore, the outer housing 41 and the inner housing 42 can be freely slid circumferentially relative to each other. Also, the slide packings (not shown) permit an interior of the inner housing 42 to be kept air-tight and liquid-tight to exterior.

In this toner cartridge 40, The outer housing 41 is movable to the toner close position. At the toner close position, the outer housing 41 permits the interior of the inner housing 42 to be sealed hermetically by closing the second vents 55 of the inner housing 42 with the cylindrical external wall 45 except regions where the first vents 49 are formed At the toner close position, the external lugs 47 and the internal lugs 54 are in the same straight line drawn radially outwardly from the agitator rotating shaft 53. On the other hand, the outer housing 41 is movable to the toner open position. At the toner open position, the outer housing 41 permits the interior of the inner housing 42 to be opened by making the first vents 49 and the second vents 55 oppose to each other. At the toner open position, where the external lugs 47, the internal lugs 54, and the agitator rotating shaft 53 are positioned to make a certain angle, as viewed from side elevation.

The inner housing 42 contains toner including one positively-charged nonmagnetic component as developing agent. Polymerized toner produced by allowing polymerizable monomer (including, for example, styrene monomer such as styrene etc, and acrylic monomer such as acrylic acid, alkyl (C1-C4) acrylate and alkyl (C1-C4) methacrylate etc) to be copolymerized by suspension polymerization or the like, is used as the toner. The polymerized toner is generally spherical in shape and is so excellent in fluidity that high-definition images can be formed.

Colorant such as carbon black etc, and wax etc are mixed in the toner. In order to improve the fluidity of the toner, additive material, such as silica etc, is also added to the toner. A mean particle diameter of the toner is about 6 micro meter to about 10 micro meter.

As shown in FIGS. 4 (*a*) to 4(*c*), the development left side wall 65 and the development right side wall 66 of the development housing 62 are respectively provided with toner detection windows 57 for detecting a remaining amount of toner accommodated in the toner cartridge 40 at locations corresponding to the toner cartridge 40 when the toner cartridge 40 is accommodated in the toner cartridge accommodation chamber 71.

The main body casing 2 is provided with a toner empty sensor (not shown) including a light emitting element and a light receiving element. The light emitting element (not shown) is disposed at the outside of one of the toner detection windows 57, and the light receiving element (not shown) is disposed at the outside of the other toner detection window 57. A detection beam is output from the light emitting element, then is input into the toner cartridge 40 through the one toner detection window 57. Next, the detection beam is output from the toner cartridge 40 through the other toner detection window 57, then is detected by the light receiving element. Thus, the toner empty sensor judges the remaining amount of toner according to how frequently the detection beam is detected.

When the remaining amount of toner accommodated in the toner cartridge 40 becomes low, a toner-empty warning is displayed in an operation panel (not shown) and the like in accordance with the judgement of the toner empty sensor.

(b-4) Mounting/Dismounting of the Toner Cartridge In/From the Process Cartridge (b-4-i) Mounting of the Toner Cartridge In the laser printer 1, the flat bed unit 6 is opened by being turned around the pivot shaft 8 to open the mounting port 7 of the main body casing 2, as shown in FIG. 2. Then, the process cartridge 21 is exposed from the mounting port 7 and the toner cartridge accommodation chamber 71 of the developer unit 30 is opened toward the upper side.

Then, as shown in FIG. 4(*c*), the guide lever 44 of the toner cartridge 40 where the outer housing 41 is in the toner close position, is gripped. Then, the toner cartridge 40 is began to be mounted, from above, in obliquely forward and downward direction, in the state where the guide lever 44 is positioned above the cylindrical portion 43. In this way, the toner cartridge 40 is accommodated in the toner accommodation chamber 71. At this time, the external lugs 47 and the internal lugs 54 provided at both widthwise ends portions of the toner cartridge 40 are respectively guided by the linear groove portions 98 of the guide grooves 97, as shown in FIG. 4(*b*).

When the external lugs 47 moving downward along the linear groove portions 98 following the downward movement of the toner cartridge 40 in the toner cartridge accommodation chamber 71, are brought into abutment with the lower end portions of the linear groove portions 98 respectively, the mounting of the toner cartridge 40 in the toner cartridge accommodation chamber 71 is completed. In the toner cartridge 40 accommodated in the toner accommodation chamber 71, the guide lever 44 of the outer housing 41 which is in the toner close position, is positioned so that the distal end portion of the lever 44 is above an upper edge of the main body casing 2 (this position of the guide lever 44 is herein after referred to as the second position), as indicated by a broken line of FIG. 2. In detail, the distal end of the guide lever 44 which is in the toner close position, is positioned within a semicircular-arc region, as viewed from side elevation, formed as a swinging track of the flat bed unit 6 swinging between its spaced position and its close position.

At this time, as shown in FIG. 4(*b*), the internal lugs 54 at locations on the radially inner side of the external lugs 47 (or on the agitator rotation shaft 53 side) in the toner cartridge 40, are vertically in the middle of the linear groove portions 98 and do not reach the lower end portions of the linear groove portions 98. Thus, the pivoting of the inner housing 42 is limited. On the other hand, the external lugs 47 abutted with the lower ends of the linear groove portions 98 are respectively opposed to the curved groove portions 99 extending continuously from the linear groove portions 98. Thus, the pivoting of the outer housing 41 is allowed within the range where the external lugs 47 is movable to the curved groove portions 99.

In addition, the shutter 111 arranged in the interior of the above-described toner cartridge accommodation chamber 71, is in the development close position. When the toner cartridge 40 is mounted in the toner cartridge accommodation chamber 71, the first radial lugs 48 of the outer housing 41 penetrates the first penetrate holes 112 of the shutter 111 and are fitted in the circumferential grooves 110 of the curved wall 75, respectively, as shown in FIG. 3(*b*). At the same time as this, lower edges of the second radial lugs 50 of the outer housing 41 are held on the upper edges of the shutter 111, respectively.

Then, when the guide lever 44 is turned around the agitator rotating shaft 53 in the counterclockwise direction, as viewed from right side, the outer housing 41 is moved relative to the inner housing 42 and is shifted from the toner close position to the toner open position, while at the same time, the shutter 111 is pressed by the first radial lugs 48 penetrating the first penetrate holes 112 and is shifted from the development close position to the development open position.

In detail of the outer housing 41, following the pivoting of the guide lever 44, the cylindrical portion 43 provided with the guide lever 44 is also pivoted in the pivoting direction of the guide lever 44 (in the counterclockwise direction, as viewed from right side, described above). Following this movement, as shown in FIG. 4 (*a*), the external lugs 47 which are in abutment with the lower edges of the linear groove portions 98, are guided to pivot in the pivoting direction of the guide lever 44 respectively by the curved groove portions 99 extending continuously from the lower edges of the linear groove portions 98.

When the external lugs 47 are respectively brought into abutment with the other edges of the curved groove portions 99 on the opposite side to one ends thereof extending continuously from the lower edges of the linear groove portions 98, the pivoting of the outer housing 41 or the pivoting of the guide lever 44 and the cylindrical portion 43, is limited. Then, the movement of the outer housing 41 relative to the inner housing 42 from the toner close position to the toner open position, is completed. At this time, the distal edge of the guide lever 44 limited in pivoting, is opposed to the rear edge of the first top wall 115 of the development top wall 67 of the developing unit 30 anteroposteriorly, therefore, the guide lever 44 continues with the first top wall 115 so that the guide lever 44 and the first top wall 115, are abutted with each other slightly upward, as viewed in section from side elevation (this position of the guide lever 44 is herein after referred to as the first position).

Also, as shown in FIG. 1, a space is formed between the upper surfaces of the first top wall 115 and guide lever 44 which are continuous with each other, and a lower surface of a sheet carrier guide 130 described later of the flat bed unit 6 which is in the close position. This space is defined by the height from the edges of the second guide lugs 92 on the downstream side of the projecting direction to the edges of the second guide ribs 93 on the downstream side of the projecting direction, the width between the widthwise inner edges of the second guide lugs 92 (see FIG. 4(*a*)), the upper surfaces of the guide lever 44 and first top wall 115 which are continuous with each other, and apart of the outer periphery of the cylindrical external wall 45 near the base end portion of the guide lever 44 (an area of the cylindrical external wall 45 opposing to lower surface of the sheet carrier guide 130 in FIG. 1). This space forms a part of the transport path of the sheet 3, in this space the sheet 3 is carried in the image forming operation. At this time, the second guide ribs 93 are disposed to project toward the first top wall 115 and the front ends of the second guide rids 93 are configured put onto the rear end portions of the first guide ribs 91 to allow the sheet 3 to be well carried.

As shown in FIG. 2, when the outer housing 41 is in the toner close position, the distal end portion of the guide lever 44 is positioned above the upper edge of the main body casing 2. On the other hand, when the outer housing 41 is moved to the toner open position, the distal end portion of the guide lever 44 is accommodated in the main body casing 2.

Then, following the pivoting of the guide lever 44 and outer housing 41, the first radial lugs 48 which respectively penetrates the first penetrate holes 112 of the shutter 111 and are in engagement with the circumferential grooves 110, as shown in FIG. 3(*a*), are guided by the circumferential grooves 110 to pivot in the pivoting direction of the guide lever 44. The first radial lugs 48 are respectively brought into abutment into the rear edges of the circumferential grooves 110, when the external lugs 47 are respectively brought into abutment with the above-mentioned other edges of the curved groove portions 99.

Also, the shutter 111 which is in the state where the lower edges of the second radial lugs 50 of the outer diameter 41 hold on the upper edge of the shutter 111 and the first radial lugs 48 of the outer housing 41 penetrate the first penetrate holes 112 in the shutter 111 respectively, is also pivoted in the pivoting direction of the guide lever 44 according to that the upper edge of the shutter 111 is pressed by the lower edges of the second radial lugs 50 as well as by the first radial lugs 48 at the first penetrate holes 112. Thus, at the same time when the shift of the outer housing 41 from the toner close position to the toner open position is completed, the shift of the shutter 111 from the development close position to the development open position is also completed.

In the toner cartridge accommodation chamber 71 where the shutter 111 is in the development open position and the toner cartridge 40 where the outer housing 41 is in the toner open position, the introduction ports 88 of the toner cartridge accommodation chamber 71 are respectively opposed to the first vents 49 and the second vents 55 of the toner cartridge 40 which are in the opposed relation to each other. Therefore, the interior of the inner housing 42 of the toner cartridge 40 and the interior of the developing chamber 72 of the developing unit 30 communicate with each other through the introduction ports 88, the first vents 49, and the second ports 55.

Also, the second radial lugs 50 are brought into abutment with the introduction ports 88 respectively to close around the introduction ports 88, so that the introduction ports 88 and the first vents 49 are shielded to prevent leaking of the toner to the exterior.

As described above, the outer housing 41 is pivoted from the toner close position to the toner open position, whereas the inner housing 42 is circumferentially slidable relative to the outer housing 41. Also, the internal lugs 54 are respectively vertically in the middle of the linear groove portions 98 and do not reach the lower end portions of the linear groove portions 98, and are not opposed to the curved groove portions 99. Thus, the inner housing 42 is restrained from pivoting together with the outer housing 41 following the pivoting of the guide lever 44.

(b-4-ii) Dismounting of the Toner Cartridge

When the guide lever 44 is operated to pivot in the clockwise direction, as viewed from right side, in the state where the shutter 111 is in the development open position and the outer housing 41 is in the toner open position with respect to the inner housing 42, the outer housing 41 is shifted relative to the inner housing 42 from the toner open position to the toner close position. At the same time the shutter 111 is shifted from the development open position to the development close position by being pressed by the first radial lugs 48 respectively penetrating the first penetrate holes 112. Since the second top wall 116 is concaved with a step to form a space between the second top wall 116 and the guide lever 44, the guide lever 44 can be operated easily by inserting a finger in the space.

In detail, in the outer housing 41 following the pivoting of the guide lever 44, the cylindrical portion 43 provided with the guide lever 44 thereon is also pivoted in the pivoting direction of the guide lever 44 (in the clockwise direction described above), as shown in FIG. 4(*b*). Along with this, the external lugs 47 respectively abutting with the above-described other edges of the curved groove portions 99 (see FIG. 4(*a*)) are also guided by the curved groove portions 99 to pivot in the pivoting direction of the guide lever 44.

When the external lugs 47 reach the lower end portions of the linear groove portions 98 continuous with one end portions of the curved groove portions 99 respectively, the pivoting of the outer housing 41, or the pivoting of the guide lever 44 and the cylindrical portion 43, is restricted, so that the shift of the outer housing 41 from the toner open position to the toner close position relative to the inner housing 42 is completed.

Then, following the pivoting of the guide lever 44 and the cylindrical portion 43, the first radial lugs 48 penetrating the first penetrate holes 112 of the shutter 111 and fitted in the circumferential grooves 110 are respectively also guided by the circumferential grooves 110 to pivot in the pivoting direction of the guide lever 44, as shown in FIG. 3(*b*). At the same time when the external lugs 47 reach the lower end portions of the linear groove portions 98 continuous with one end portions of the curved groove portions 99, respectively the first radial lugs 48 are brought into abutment with the front edges of the circumferential grooves 110 respectively.

The shutter 111, where the first penetrate holes 112 are penetrated respectively by the first radial lugs 48 of the outer housing 41, is also pivoted in the pivoting direction of the guide lever 44. Therefore, at the same time when the shift of the outer housing 41 from the toner open position to the toner close position is completed, the shift of the shutter 111 from the development open position to the development close position is also completed.

After the completion of the shift of the outer housing 41 from the toner open position to the toner close position and the shift of the shutter 111 from the development open position to the development close position, the toner cartridge 40 is dismounted from the toner cartridge accommodation chamber 71 to an obliquely rearward and upward direction, as shown in FIG. 3(*c*). Then, the first radial lugs 48 are respectively spaced away from the first penetrate holes 112 of the shutter 111 and the circumferential grooves 110 of the curved wall 75 respectively, also the second radial lugs 50 of the outer housing 41 are spaced away from the shutter 111 respectively.

Then, as shown in FIG. 4(*c*), the toner cartridge 40 is raised up with its external lugs 47 and internal lugs 54 guided by the linear groove portions 98 of the guide grooves 97 respectively. When the external lugs 47 and the internal lugs 54 are released from the linear groove portions 98 respectively, the dismounting of the toner cartridge 40 from the toner cartridge accommodation chamber 71 is completed.

(b-5) Developing/Transferring Operation

When an image is formed by the laser printer 1 after the toner cartridge 40 is accommodated in the toner cartridge accommodation chamber 71, as described above (b-4-i), the driving force from the motor (not shown) is input to the agitator rotating shaft 53 through the agitator gear 100. Then, the agitator rotating shaft 53 is rotated in the clockwise direction as viewed in right side, so that the agitator 56 is moved around the agitator rotation shaft 53 circumferentially in the inside of the inner housing 42, as shown in FIG. 3(*a*). Then, the toner accommodated in the toner cartridge 40 is agitated by the agitator 56 and is discharged into the developing chamber 72 via the first vents 49, the second vents 55, and the introduction ports 88.

The toner discharged from the introduction ports 88 into the developing chamber 72 is fed onto the developer roller 104 by the rotation of the feed roller 101, during which the toner is positively by friction charged between the feed roller 101 and the developer roller 104. Following the rotation of the developer roller 104, the toner fed onto the developer roller 104 goes between the pressing portion 108 of the layer-thickness regulating blade 107 and the rubber roller 106 of the developer roller 104 and is carried on the developer roller 104 in the form of a thin layer having a uniform thickness.

Along with the rotation of the photosensitive drum 28, a surface of the photosensitive drum 28 is positively charged uniformly by the scorotron charger 29, at first. Then, the surface of the photosensitive drum 28 is exposed to light from the scanner 20 by high-speed scanning using laser beam, to form thereon an electrostatic latent image corresponding to an image to be formed on the sheet 3.

Then, when the toner carried on the developer roller 104 and positively charged is opposed to and brought into contact with the photosensitive drum 28 by the rotation of the developer roller 104, the toner is fed to the electrostatic latent image formed on the surface of the photosensitive drum 28, in other words, the toner is fed to the exposed part of the uniformly-positively-charged surface of the photosensitive drum 28, which is exposed to the laser beam and drops in electric potential. As a result, the electrostatic latent image on the surface of the photosensitive drum 28 is converted to a visible image and the visible toner image created by the reversal developing process is carried on the surface of the photosensitive drum 28.

Thereafter, the toner image carried on the surface of the photosensitive drum 28 is sent by the registration roller 16. During the time when the sheet 3 which enters the drum housing 76 from the first passing port 84 passes the transfer position between the photosensitive drum 28 and the transfer roller 31, the toner image is transferred to the sheet 3 by the transfer bias applied to the transfer roller 31.

As shown in FIG. 1, the sheet 3 is turned forward around the separation roller 10 in a generally U-shape and then is moved onto the toner cartridge 40. After passing through the space between the upper surface of the first top wall 115 of the developing unit 30 and the guide lever 44 which is in the toner open position, and the lower surface of the flat bed unit 6, the sheet 3 enters the first passing port 84 of the drum portion 27 and reaches the transfer position.

Then, the sheet 3 onto which the toner image was transferred is ejected from the second passing port 85 to the exterior of the drum housing 76 and thereafter is sent to the fixation unit 22.

The remaining toner left on the photosensitive drum 28 after transfer is collected by the developer roller 104.

(c) Fixation Unit

The fixation unit 22 is arranged to be adjacent to and above the scanner 20 and also arranged in front of the process cartridge 21. The fixation unit 22 includes a fixation frame 58, a heating roller 59, a pressing roller 60, and a sheet ejection roller 96. The heating roller 59, the pressing roller 60, and the sheet ejection roller 96 are provided in the fixation frame 58.

The heating roller 59 includes a metal pipe whose surface is coated with a fluorine resin, and a halogen lamp, inserted in the metal pipe, for heating. The heating roller 59 is rotationally driven by a driving force input from a motor (not shown).

The pressing roller 60 is disposed opposite to and above the heating roller 59 to press it. The pressing roller 60 includes a metal roller shaft, and a rubber roller formed of rubber material and covering the roller shaft. The pressing roller 60 is driven following the rotational drive of the pressing roller 59.

The sheet ejection rollers 96 includes a pair of rollers and are disposed on the downstream side of the sheet transporting direction with respect to the heating roller 59 and the pressing roller 60.

The toner image transferred on the sheet 3 at the transfer position is thermally fixated at the fixation unit 22 during the time when the sheet 3 passes through between the heating roller 59 and the pressing roller 60. The sheet 3 on which the toner image was fixated is carried toward the sheet ejection tray 95 by the sheet ejection rollers 96 through an ejection port 148.

(4) Ejection Section

Figure 7:
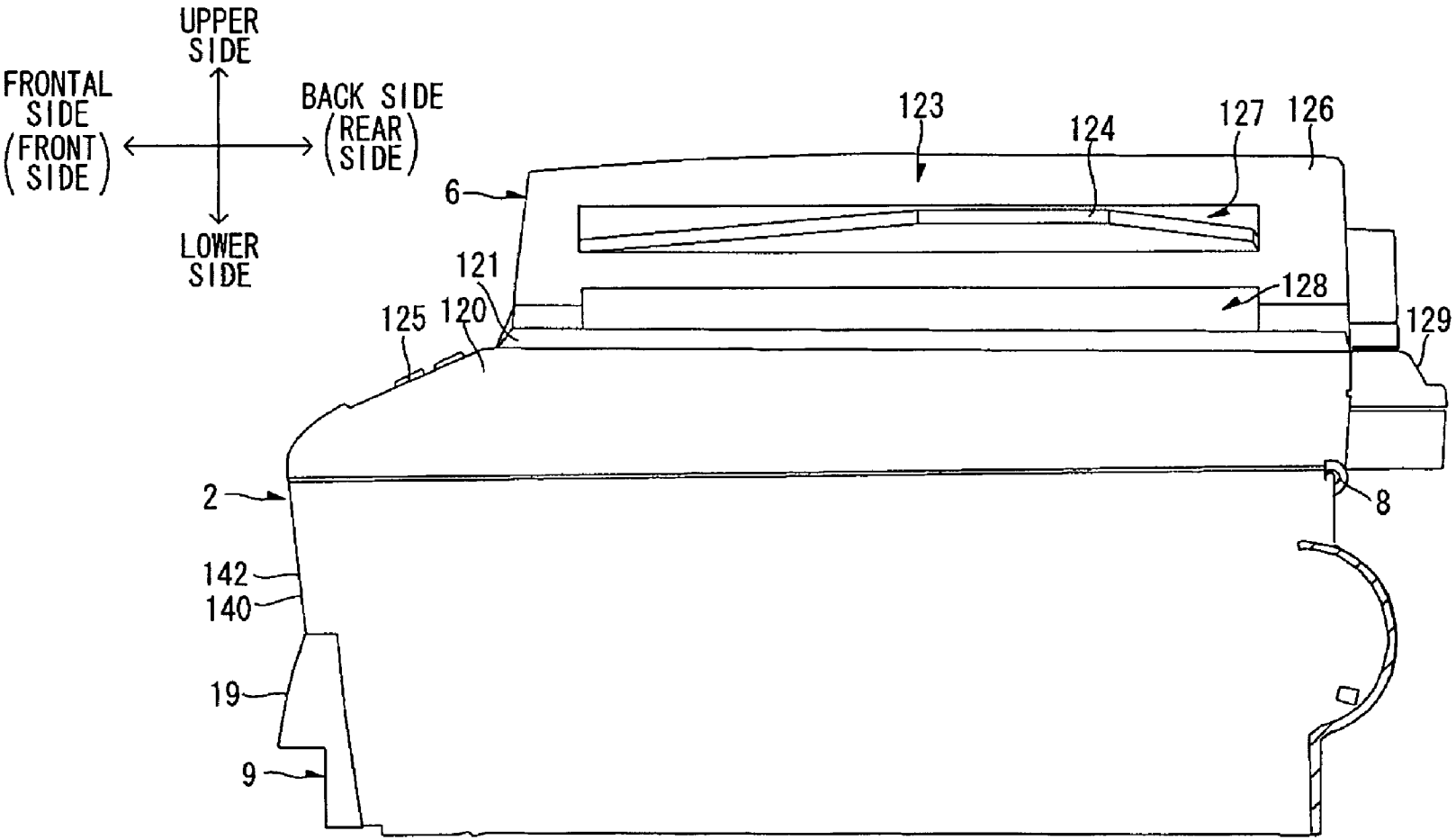
FIG. 7 is a right side view of the laser printer shown in FIG. 1.
Figure 8:
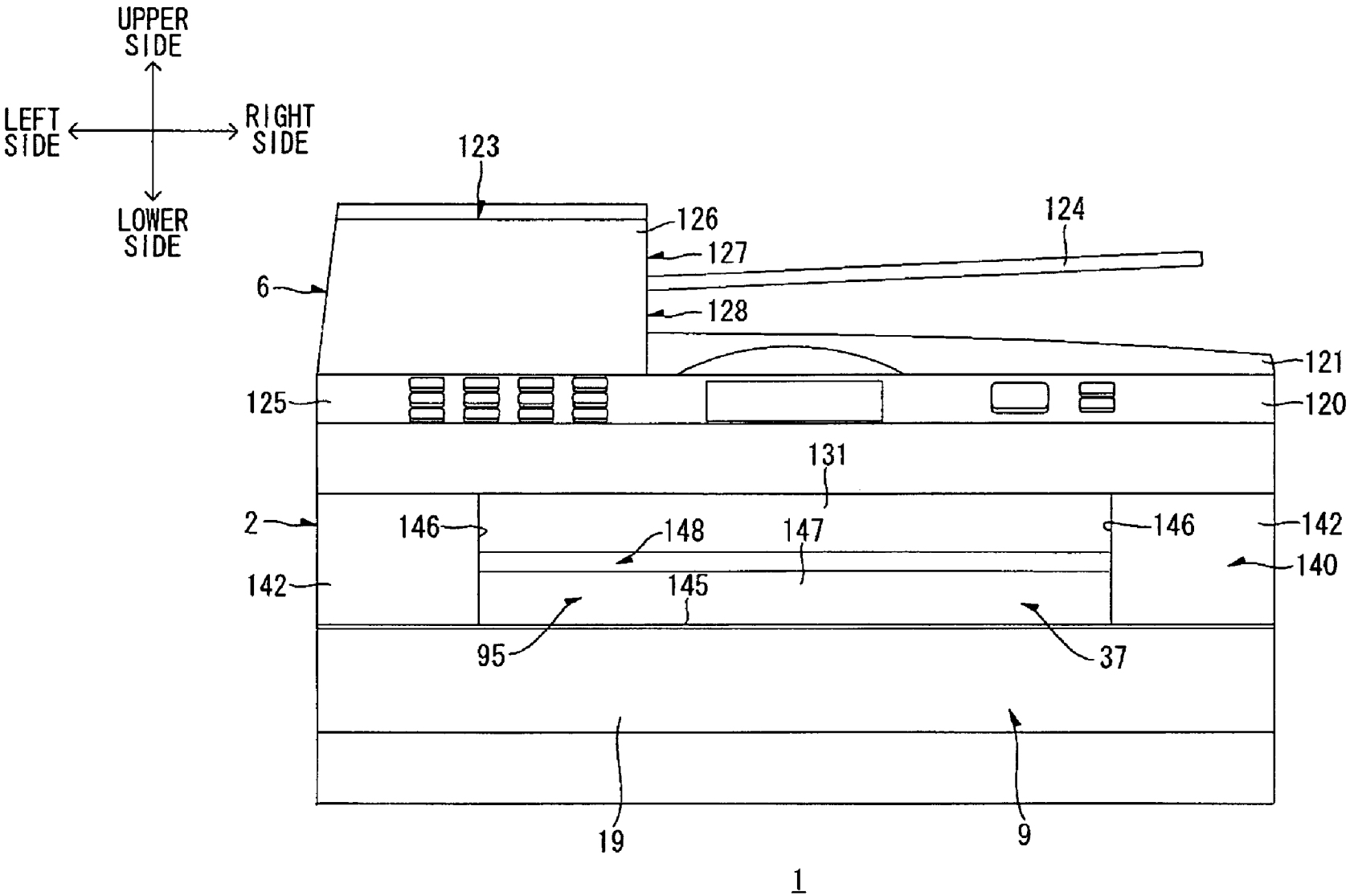
FIG. 8 is a front view of the laser printer shown in FIG. 1.

FIG. 7 is a right side view of the laser printer shown in FIG. 1, and FIG. 8 is a front view of the laser printer shown in FIG. 1.

The ejection section 37 includes the sheet ejection tray 95 and the ejection port 148 on the front side of the main body casing 2.

As shown in FIG. 8, the front side wall 140 of the main body casing 2 is provided on both ends thereof with a pair of front end walls 142. The front side wall 140 has the sheet ejection tray 95 concaved rearwards thereof in a region thereof sandwiched widthwise between the pair of front end walls 142, as shown in FIG. 1. The sheet ejection tray 95 is disposed to overlap upwardly with a front half portion of the sheet feed tray 9 and the scanner 20.

In detail, as shown in FIG. 8, the sheet ejection tray 95 has an ejection bottom wall 145, a pair of ejection side walls 146, and an ejection rear wall 147 (ejection wall). The ejection bottom wall 145 is formed in a generally rectangular plate form, as viewed from top, extending rearwards continuously from a lower edge of the front side wall 140 at the portion thereof which is widthwise sandwiched between the pair of front end walls 142.

The pair of ejection side walls 146 are extended upwards from both widthwise edge of the ejection bottom wall 145 to oppose to each other. Upper edges of the ejection side walls 146 are flush with upper edge of the front side walls 140.

The ejection rear wall 147 is formed in a rectangular plate form, as viewed from front, extends upwards continuously from a rear edge of the ejection bottom wall 145 and is extended between generally lower half portions of the ejection side walls 146. The ejection rear wall 147 is placed adjacent to and in front of the fixation unit 22, as shown in FIG. 1. Therefore, an upper edge of the ejection rear wall 147 is at a generally vertical center of the ejection side wall 146.

When the flat bed unit 6 is closed and the mounting port 7 in the main body casing 2 is closed, the sheet ejection tray 95 is opened on the front side. When the flat bed unit 6 is opened and the mounting port 7 is opened, the sheet ejection tray 95 is opened on the top side as well, as shown in FIG. 2.

The flat bed unit 6 has a scanner-side ejection rear wall 131 formed on a lower surface of a document mounting table 120 described later at a generally anteroposterior center and a widthwise center thereof, extending downwardly from the lower surface of the document mounting table 120. The scanner-side ejection rear wall 131 is formed in a rectangular form, as viewed from front, having the same size as the ejection rear wall 147 of the main body casing 2, as shown in FIG. 8. When the flat bed unit 6 is closed and the mounting port 7 of the main body casing 2 is closed, the lower edge of the scanner-side ejection rear wall 131 is opposed to the upper edge of the ejection rear wall 147 at a vertically spaced interval, as shown in FIG. 1. The interval is larger than the thickness of the sheet 3 and serves as the ejection port 148 for allowing the fixation unit 22 and the sheet ejection tray 95 to communicate with each other.

The sheet 3 thermally fixated in the fixation unit 22 is ejected onto the ejection bottom wall 145 of the sheet ejection tray 95 through the ejection port 148 by the sheet ejection rollers 96.

(5) Flat Bed Unit (a) Overall Structure of the Flat Bed Unit

Figure 9:
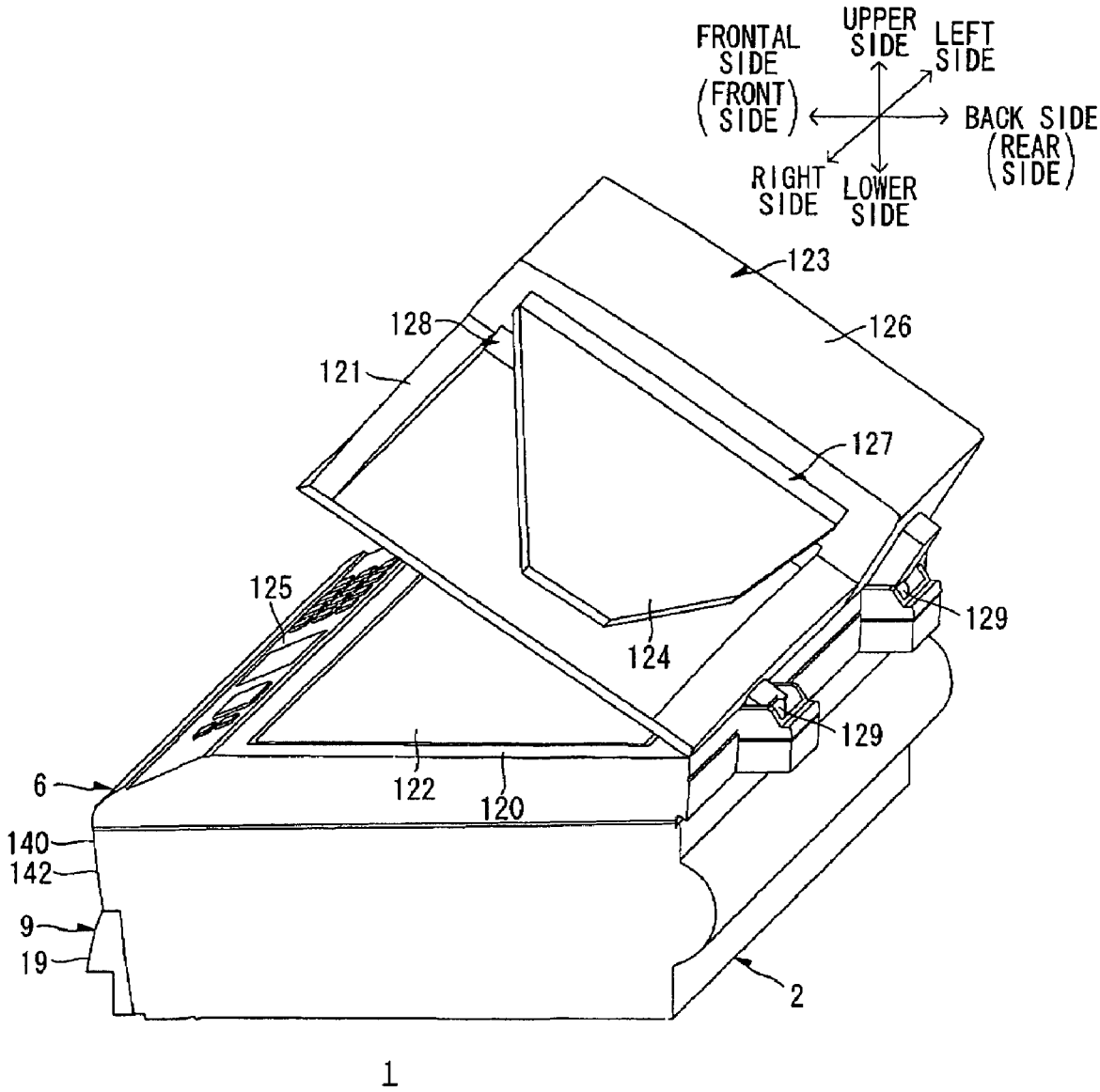
FIG. 9 is aright-side perspective view of the laser printer shown in FIG. 1, as viewed from above and behind, showing the state of a front end portion of a document holding cover being lifted up to open a glass surface of a document mounting table.

FIG. 9 is a right-side perspective view of the laser printer shown in FIG. 1, as viewed from above and behind, and shows the state where a front end portion of a document holding cover is lifted up to open a glass surface of the document mounting table.

The flat bed unit 6 includes the document mounting table 120, and a document holding cover 121 supported on the document mounting table 120 in a freely open/close manner, as shown in FIG. 9.

The document mounting table 120 is formed in generally rectangular thick plate, as viewed from top. The document mounting table 120 has a glass surface 122 formed on an upper surface thereof for putting a document thereon, an operation panel 125 formed on a front end portion thereof, and the above-mentioned scanner-side ejection rear wall 131 (see FIG. 2) and the sheet carrier guide 130 (see FIG. 2) both of which are formed on a lower surface thereof.

The glass surface 122 is formed by embedding a sheet of glass in the document mounting table 120 so that the upper surface of the document mounting table 120 is flat. The glass surface 122 is in a rectangular form, as viewed from top, whose anteroposterior dimension extends along the anteroposterior direction of the document mounting table 120.

The document mounting table 120 has a CCD sensor (not shown) for scanning the document and a scan motor (not shown) for moving the CCD sensor for the scanning in the state of facing the glass surface 112.

The CCD sensor (not shown) is supported to be movable in a transverse direction on the inner side (under side) of the glass surface 122 and is normally on standby at the left end of the glass surface 122. In the usual scanning of the document, the CCD sensor is moved for the scanning from the left side to the right side in the state of facing the glass surface 112 by the scan motor (not shown).

The operation panel 125 is arranged on the front end portion of the flat bed unit 6 and includes a liquid crystal panel for indicating an operational state of the laser printer 1 and the like, and key-buttons and the like which a user can operate for setting various conditions.

The sheet carrier guide 130 is formed to be elongated in the transverse direction and is also formed to be gently concaved upward so that when the flat bed unit 6 is closed and the mounting port 7 at the top of the main body casing 2 is closed, the sheet carrier guide 130 can extend along the upper surface of the first top wall 115 and the guide lever 44 in a spaced relation, as shown in FIG. 1.

One of the pair of registration rollers 16 above-mentioned is freely rotatably supported by the sheet carrier guide 130 at the rear and lower end portion thereof.

The document holding cover 121 is formed in a thin rectangular plate having the same shape as the document mounting table 120, as shown in FIG. 9. The document holding cover 121 is provided on the left end portion of its upper surface, with an ADF 123 (Auto-Document-Feeder) for automatically reading the document. The ADF 123 includes a casing 126, a document feed roller (not shown), a document feed motor (not shown), and a document detection sensor (not shown). The casing 126 is formed in a box elongated in the anteroposterior direction and has the document feed roller (not shown) and the document feed motor (not shown) built therein, and a standby document tray 124 arranged on the right side wall at a vertical center portion thereof, as shown in FIG. 8. The standby document tray 124 is in the form of a thin plate of a generally trapezoidal form as viewed from top (see FIG. 9). The standby document tray 124 is supported by the ADF 123 with its bottom portion of the general trapezoid as a base end portion, and its distal end portion extended rightwards in a generally horizontal direction. The standby document tray 124 can permit documents to be set in a stacked relation.

The right side wall of the casing 126 has a document intake port 127 formed on an upper side of the standby document tray 124 for taking the document in an interior of the casing 126, and a document ejection port 128 formed on a lower side of the standby document tray 124 for ejecting the document from the casing 126, as shown in FIG. 7. The document intake port 127 and the document ejection port 128 are both formed in a rectangular shape elongated in the anteroposterior direction.

The document holding cover 121 is swingably supported at a rear end portion thereof by a rear end portion of the document mounting table 120 via hinges 129, as shown in FIG. 9.

A front end portion of the document holding cover 121 is swung vertically around the hinges 129 at the rear end portion. When a front end portion of the document holding cover 121 is lifted up, the glass surface 122 of the document mounting table 120 is exposed. On the other hand, when the front end portion of the document holding cover 121 is lifted down, the glass surface 122 of the document mounting table 120 is covered. Thus, the glass surface 122 of the document mounting table 120 is covered by the document holding cover 121 in a freely opened and closed manner.

(b) Normal Scanning of the Document by the Flat Bed Unit

In the flat bed unit 6, the front end portion of the document holding cover 121 is lifted up and the document is set on the glass surface 122. Then, the front end portion of the document holding cover 121 is lifted down and the command is entered with the buttons on the operation panel 125. Then, the CCD sensor (not shown) is moved from the left side toward the right side, in the state of facing the document put on the glass surface 122, to scan the image data of the document.

After completion of the scanning of the document, the front end portion of the document holding cover 121 is lifted up again and the document is taken away from the glass surface 122. After the completion of the scanning, the CCD sensor (not shown) is automatically moved back to the left end of the glass surface 122 by the scan motor (not shown) and is held in a standby state there.

(c) Automatic Scanning of the Document by the Flat Bed Unit

In the automatic scanning of the document by the ADF 123, when the document put on the standby document tray 124 is detected by the document detection sensor (not shown), the CCD sensor (not shown) is fixed at an automatic document scanning position, not shown, differently from the normal scanning of the document described above. Then, when a user enters a command with the buttons on the operation panel 125, the document feed motor (not shown) is driven to rotate the document feed roller (not shown) by the driving force from the motor. Following the rotation of the document feed roller (not shown), the document is moved leftwards and is taken in the interior of the casing 126 via the document intake port 127. When the document taken in passes through the document carrying path (not shown) and is brought into a position opposing to the CCD sensor (not shown), image data of the document is scanned by the scanning of the CCD sensor (not shown). Thereafter, the document is moved rightwards from the document ejection port 128 and ejected onto an upper surface of the document holding cover 121.

(d) Image Formation Based on Image Data of the Scanned Document

As shown in FIG. 1, in the image forming section 5, the image data is created based on the above-mentioned image data of the document scanned by the CCD sensor (not shown) and the image is formed on the sheet 3, as described above.

2. Operation and Effect

As described above, in this laser printer 1, the sheet 3 is fed from the sheet feed tray 9, then turned forward around the separation roller 10 in a generally U-shape, and then moved over the toner cartridge 40. Then, after passing the space, which is formed between the upper surface of the first top wall 115 of the developing unit 30, the upper surface of the guide lever 44 being continuous with the first top wall 115 in the toner open position, and a part of the outer periphery of the cylindrical external wall 45 adjacent to the base end portion of the guide lever 44, and the lower surface of the flat bed unit 6, which serves as a part of the transport path, the sheet 3 is ejected onto the sheet ejection tray 95.

This enables the transport path of the sheet 3 to increase in radius of curvature at the U-turn point, and can achieve a reliable feed of the sheet 3 with a reduced risk of sheet jam. Further, since the sheet 3 is carried over the process cartridge 21, when a sheet jam occurs, the sheet 3 can be easily removed.

The guide lever 44, when taking the toner open position, forms a part of the transport path. Thus, the guide lever 44 can also serve as apart of the components forming the transport path. Hence, as compared with a transport path formed by separate components, the number of components forming the transport path can be reduced, and this can allow reduction in size of the laser printer 1.

Also, this guide lever 44 can operate to facilitate the replacement of the toner cartridge.

Further, since the guide lever 44 also serves as a gripped portion to be gripped when the toner cartridge 40 is mounted and dismounted in and from the laser printer 1, the toner cartridge 40 can be replaced with further ease by gripping the guide lever 44.

When the guide lever 44 takes the toner open position, the first vents 49 of the outer housing 41 and the second vents 55 of the inner housing 42 oppose to each other respectively to open the interior of the inner housing 42 of the toner cartridge 40 containing the toner, while at the same time, the guide lever 44 forms a part of the above-mentioned transport path of the sheet 3 and thereby the transport path is brought into completion. Thus, a reliable ejection of the toner from the each first vent 49 and a reliable transport of the sheet 3 can be achieved.

On the other hand, when the guide lever 44 takes the toner close position, the second vents 55 are closed by the cylindrical external wall 45, except an area thereof where the first vents 49 are formed, to seal the interior of the inner housing 42, while at the same time, the guide lever 44 comes to be discontinuous with the first top wall 115 to prevent the formation of part of the transport path of the sheet 3, so that the transport path of the sheet 3 is not completed. Thus, the transport of the sheet 3 and the ejection of the toner can be reliably stopped.

This can produce the result that operation reliability of the laser printer 1 can be improved.

Also, when the guide lever 44 takes the toner open position, the first vents 49 and the second vents 55 opposed to each other respectively to open the interior of the inner housing 42 containing the toner, while at the same time, the shutter 111 is shifted to the development open position to open the introduction ports 88 formed in the development housing 62 of the developing unit 30. As a result of this, the interior of the inner housing 42 and the interior of the developing chamber 72 of the developing unit 30 communicate with each other through the introduction ports 88, the first vents 49, and the second vents 55.

Thus, a reliable ejection of the toner from the interior of the inner housing 42 of the toner cartridge 40 and a reliable introduction of the toner into the interior of the developing chamber 72 of the developing unit 30 can be achieved.

On the other hand, when the guide lever 44 takes the toner close position, the second vents 55 are closed by the cylindrical external wall 45, except an area thereof where the first vents 49 are formed, while at the same time, the introduction ports 88 are closed by the shutter 111.

Thus, the ejection of the toner from the interior of the inner housing 42 and the introduction of the toner into the interior of the developing chamber 72 can be reliably prevented, and this can reliably prevent leakage of the toner.

As a result of this, the toner cartridge 40 can be taken out, while preventing the leakage of the toner therefrom. Also, leakage of the toner from the interior of the developing chamber 72 of the development housing 62 after dismounting the toner cartridge 40, can be prevented.

When the guide lever 44 is in the toner open position, the guide lever 44 takes the first position (above-mentioned) at which the guide lever 44 is continuous with the first top wall 115 and thereby forms the above-mentioned part of the transport path along the transport path of the sheet 3. This can bring the transport path into completion to achieve reliable and smooth transport of the sheet 3 along the transport path.

On the other hand, when the guide lever 44 is pivoted around the agitator rotating shaft 53 and is in the toner close position, the guide lever 44 takes the second position at which the guide lever 44 is discontinuous with the first top wall 115 and intersects with the transport path. As a result of this, the transport path is brought into incompletion to surely stop the transport of the sheet 3.

Thus, when the guide lever 44 is in the toner open position, the completion of the transport path and the opening of the introduction ports 88, the first vents 49 and the second vents 55 can be synchronized with each other to ensure a reliable image forming. On the other hand, when the guide lever 44 is in the toner close position, the incompletion of the transport path and the closing of the introduction ports 88, the first vents 49 and the second vents 55 can be synchronized with each other to provide a reliable mount and dismount of the toner cartridge 40.

This can produce the result that operation reliability of the laser printer 1 can be further improved.

The guide lever 44 in the toner open position faces the flat bed unit 6 in its closed position, and the space between the upper surface of the guide lever 44 and the lower surface of the flat bed unit 6, forms a part of the transport path, as described above. This can provide the result that when the sheet 3 carried is jammed in the transport path, the jammed sheet 3 can be removed easily by moving the flat bed unit 6 to the spaced position to open the mounting port 7 and expose the jammed sheet 3 from the mounting port 7.

The guide lever 44 is exposed from the mounting port 7 by the movement of the flat bed unit 6 to the spaced position. This can produce the advantage that when the toner cartridge 40 is dismounted from the main body casing 2, the exposed guide lever 44 can be gripped to take out the toner cartridge 40 from the main body casing 2 with ease.

Thus, an easy clearance of the sheet jam and an easy replacement of the toner cartridge 40 can be achieved.

When the guide lever 44 is in the toner close position, the guide lever 44 takes a position where its distal end portion thereof is positioned above the upper edge of the main body casing 2. In detail, the distal end portion of the guide lever 44 which is in the toner close position is positioned within a semicircular-arc region, as viewed from side elevation, formed as a swinging track of the flat bed unit 6 swinging between its spaced position and its close position.

As a result of this, when the flat bed unit 6 is moved to its close position, the lower surface of the flat bed unit 6 is brought into abutment with the distal end portion of the guide lever 44 in the midway of the movement, so that the flat bed unit 6 cannot be moved to its close position.

On the other hand, when the guide lever 44 is in the toner open position, the distal end portion of the guide lever 44 is accommodated in the main body casing 2, so that the flat bed unit 6 can be moved to its close position.

This can provide the advantage that the image forming operation can be initiated without fail after the time when the movement of the guide lever 44 toward the toner open position to open the introduction ports 88, the first vents 49 and the second ports 55, and the movement of the flat bed unit 6 to its close position are completed.

Also, since the user can easily judge whether the guide lever 44 is in the toner close position or in the toner open position from whether the flat bed unit 6 can be closed or not, the operability can be improved.

The second guide lugs 92 are provided on the upper surface of the guide lever 44 in such a manner as to project in the thickness direction of the sheet 3 passing over the upper surface of the guide lever 44. These second guide lugs 92 can surely form a space which forms a part of the transport path of the sheet 3 between the upper surface of the guide lever 44 and the lower surface of the flat bed unit 6.

Therefore, since the sheet 3 can pass through the space, a smooth transport of the sheet 3 can be achieved.

Also, when the pivoting of the toner cartridge 40 is insufficient, so that the guide lever 44 is displaced from the first position, such a displacement can be corrected by pressing the second guide lugs 92.

Also, there are provided a plurality of second guide ribs 93 equally spaced along the widthwise direction, including ridges which are provided between the second guide lugs 92 opposing to each other in the widthwise direction and are projected in the same direction as the second guide lugs 92 and extended in a direction along the sheet transporting direction in the image forming operation.

Due to these second guide ribs 93, the sheet 3 can be carried with reduced friction.

In addition, the second guide ribs 93 are formed to project from the upper surface of the guide lever 44 to a smaller extent than the second guide lugs 92 projecting from the upper surface of the guide lever 44, and the difference there between is larger than the thickness of the sheet 3.

So, this can surely form the space which forms a part of the above-mentioned transport path of the sheet 3 between the edge of the second guide lugs 92 on the downstream side of the projecting direction and the edge of the second guide ribs 93 on the downstream side of the projecting direction. Thus, a reliable transport of the sheet 3 along the second guide ribs 93 can be achieved.

3. Modifications

Figure 10:
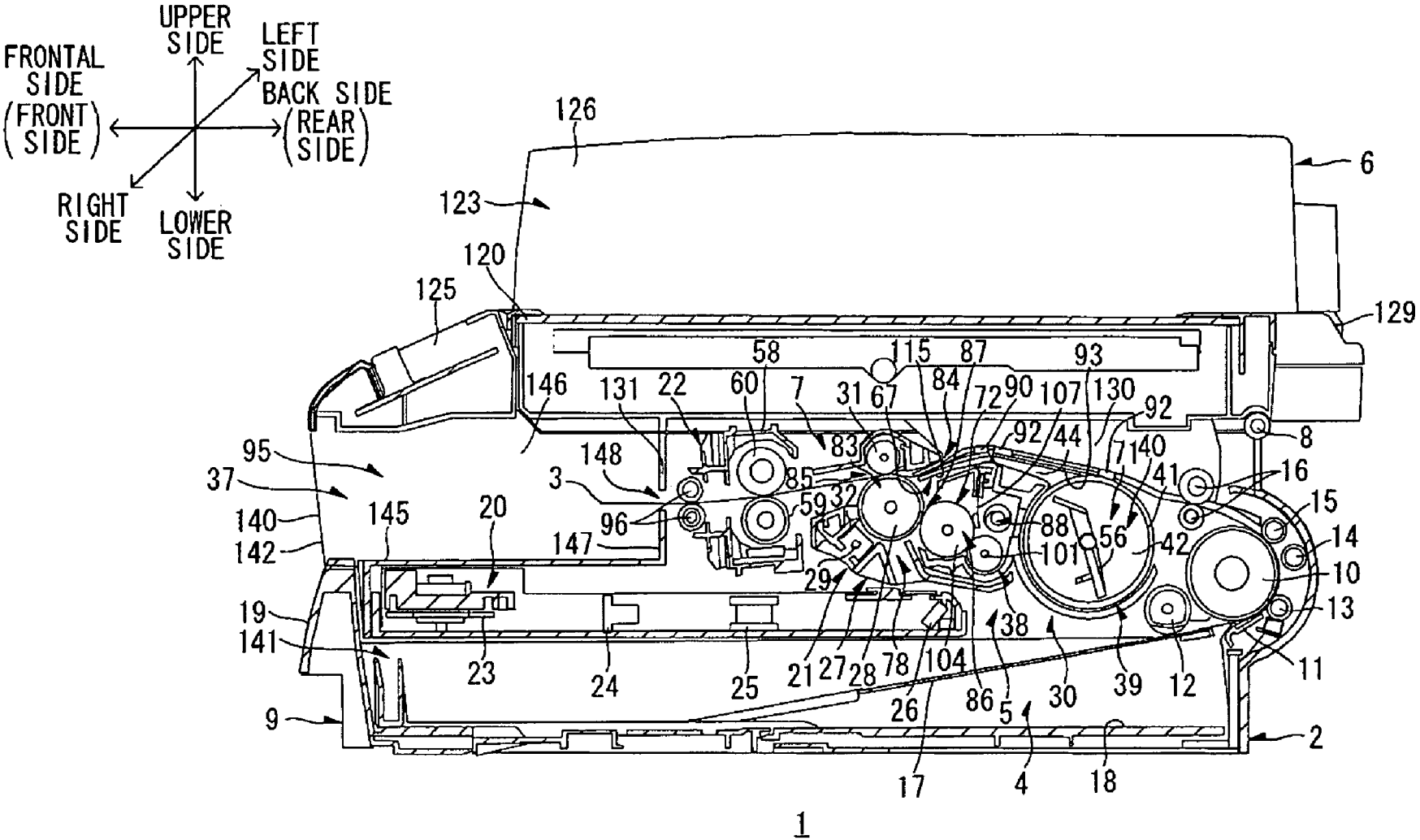
FIG. 10 shows a modification of FIG. 1 to which a second embodiment is applied.
Figure 11:
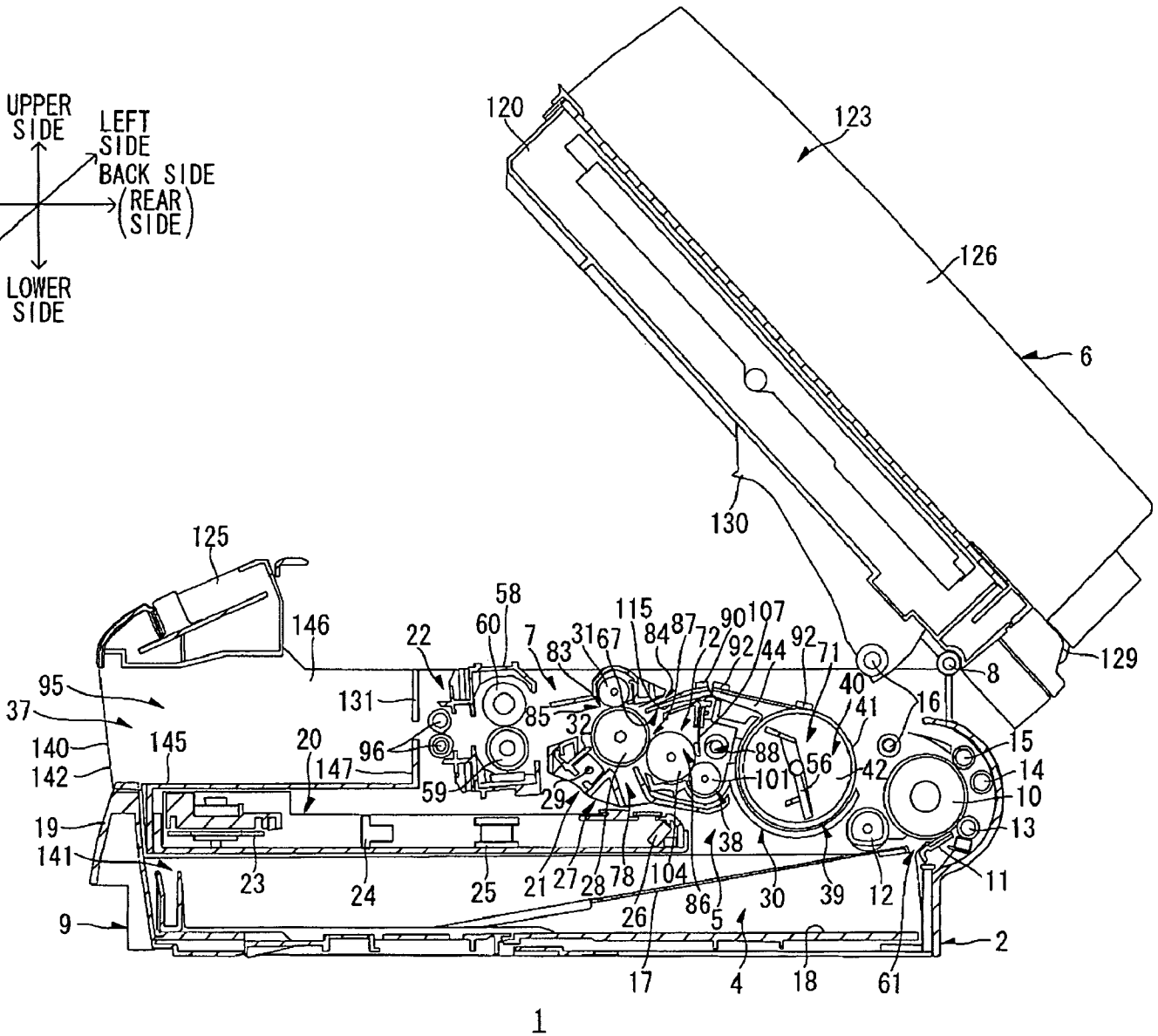
FIG. 11 shows a modification of FIG. 2 to which the second embodiment is applied.

Although the operation panel 125 is arranged on the document mounting table 120 in the first embodiment, it may be arranged on the main body casing 2. FIGS. 10 and 11 show a laser printer wherein the operation panel is arranged on the main body casing. FIG. 10 shows the state of a scanning unit of such a laser printer being closed, and FIG. 11 shows the state of the scanning unit being opened. In FIGS. 10 and 11, the same numerals are referred to members corresponding to those described above, and the description thereon is not given here.

As shown in FIGS. 10 and 11, the operation panel 125 is integrally provided to the main body casing 2 in such a manner that a front edge of the operation panel 125 is continuous with an upper edge of a frontal side wall 140 of the main body casing 2. This can provide a reduced weight of the flat bed unit 6 which is opened and closed when the toner cartridge 40 and the process cartridge 21 are mounted and dismounted in and from the main body casing 2, thus providing improved operability of the flat bed unit 6. Also, by fixing the operation panel 125 to the main body casing 2, the connection of the wiring to the operation panel 125 can be facilitated and undesirable noise generation and the like can be prevented, thus providing improved reliability of the operation panel 125.

In the above-described embodiment, the process cartridge 21 integrally includes the drum unit 27 and the developing unit 30, and the process cartridge 21 is removably mounted and dismounted in and from the main body casing 2. In addition to this, in the image forming apparatus of the present invention, for example, the drum unit 27 may be formed as a drum cartridge including the photosensitive drum 28, the scorotron charger 29, the transfer roller 31, and the cleaning brush 32 so that such a drum cartridge can be removably mounted in the main body casing 2. Likewise, the developing unit 30 may be formed as a developing cartridge including the toner cartridge accommodation chamber 71, the developer roller 104, the feed roller 101, and the layer-thickness regulating blade 107 so that such a developing cartridge can be removably mounted in the drum section 27.

The present invention is not limited to the embodiment and the operation and effect described above.

What is claimed is:

1. An image forming apparatus comprising:

an image carrier on which an electrostatic latent image is formed;

a toner cartridge detachably mountable to the image forming apparatus, including a toner casing accommodating a developing agent, an opening/closing member which opens/closes an opening formed in the toner casing to discharge the developing agent, and an operation member operating the opening/closing member; and a developing unit to develop the electrostatic latent image by the developing agent discharged from the opening, wherein the operation member can move between an open position for operating the opening/closing member to open the opening, and a close position for operating the opening/closing member to close the opening, and the operation member forms a part of a transport path of a recording medium in the image forming apparatus at the open position in a state where the toner cartridge is mounted in the image forming apparatus.

2. The image forming apparatus according to claim 1, wherein the developing unit includes a development housing, and an introduction port opening/closing member which opens/closes an introduction port formed in the development housing to introduce the developing agent discharged from the opening of the toner cartridge, and in a state where the toner cartridge is mounted in the image forming apparatus and the operation member is at the open position, the introduction port is opened by opening operation of the introduction port opening/closing member, and the introduction port is closed by closing operation of the introduction port opening/closing member when the operation member is at the close position.

3. The image forming apparatus according to claim 1, wherein the operation member takes a first position along the transport path of the recording medium when the operation member is at the open position, and the operation member takes a second position intersecting the transport path when the operation member is at the close position.

4. The image forming apparatus according to claim 1, comprising a main body opening/closing member which is opened/closed when the toner cartridge is attached/detached to/from the image forming apparatus, wherein the operation member at the open position forms a part of the transport path, at a position opposed to the main body opening/closing member.

5. The image forming apparatus according to claim 4, wherein in the state where the toner cartridge is mounted in the image forming apparatus, the operation member interferes with a moving locus of the main body opening/closing member at the close position to make impossible closing of the main body opening/closing member.

6. The image forming apparatus according to claim 1, wherein at the position for forming a part of the transport path, the operation member includes space keeping members projecting in a thickness direction of the transported recording medium from both end portions of the operation member in a direction orthogonal to a transporting direction of the recording medium.

7. The image forming apparatus according to claim 6, wherein the operation member includes a plurality of ribs arranged in the transporting direction of the recording medium between the space keeping members and projecting in the thickness direction of the transported recording medium to a smaller extent than the space keeping members.

8. An image forming apparatus comprising:

an image carrier on which an electrostatic latent image is formed;

a toner cartridge detachably mountable to the image forming apparatus, including a cylindrical casing accommodating a developing agent, and a projecting member formed on an outer periphery of the casing; and a developing unit to develop the electrostatic latent image by the developing agent discharged from the opening, wherein the toner cartridge is pivotable around a central axis of the casing in a state where the toner cartridge is mounted in the image forming apparatus, and the projecting member takes a first position along a transport path of a recording medium in the image forming apparatus and a second position intersecting the transport path when the toner cartridge is pivoted around the central axis, and the projecting member forms a part of the transport path at the first position.

9. The image forming apparatus according to claim 8, wherein at the position for forming a part of the transport path, the projecting member includes space keeping members projecting in a thickness direction of the transported recording medium from both end portions of the projecting member in a direction orthogonal to a transporting direction of the recording medium.

10. The image forming apparatus according to claim 9, wherein the projecting member includes a plurality of ribs arranged in the transporting direction of the recording medium between the space keeping members and projecting in the thickness direction of the transported recording medium to a smaller extent than the space keeping members.

11. A toner cartridge detachably mountable to an image forming apparatus, comprising:

a toner casing accommodating a developing agent; an opening/closing member which opens/closes an opening formed in the toner casing to discharge the developing agent; and an operation member which operates the opening/closing member, wherein the operation member can move between an open position for operating the opening/closing member to open the opening, and a close position for operating the opening/closing member to close the opening, and the operation member forms a part of a transport path of a recording medium in the image forming apparatus at the open position in a state where the toner cartridge is mounted in the image forming apparatus.

12. The toner cartridge according to claim 11, wherein the operation member takes a first position along the transport path of the recording medium when the operation member is at the open position, and the operation member takes a second position intersecting the transport path when the operation member is at the close position.

13. The toner cartridge according to claim 11, wherein when the operation member is at the open position, the operation member forms a part of the transport path, at a position opposed to a main body opening/closing member of the image forming apparatus which is opened/closed when the toner cartridge is attached/detached to/from the image forming apparatus.

14. The toner cartridge according to claim 11, wherein at the position for forming a part of the transport path, the operation member includes space keeping members projecting in a thickness direction of the transported recording medium from both end portions of the operation member in a direction orthogonal to a transporting direction of the recording medium.

15. The toner cartridge according to claim 14, wherein the operation member includes a plurality of ribs arranged in the transporting direction of the recording medium between the space keeping members and projecting in the thickness direction of the transported recording medium to a smaller extent than the space keeping members.

16. The toner cartridge according to claim 11, wherein the operation member also serves as a gripped portion which is gripped when the toner cartridge is attached/detached to/from the image forming apparatus.

17. A toner cartridge detachably mountable to an image forming apparatus, comprising:

a cylindrical casing accommodating a developing agent; and a projecting member formed on an outer periphery of the casing, wherein the toner cartridge is pivotable around a central axis of the casing in a state where the toner cartridge is mounted in the image forming apparatus, and the projecting member takes a first position along a transport path of a recording medium in the image forming apparatus and a second position intersecting the transport path when the toner cartridge is pivoted around the central axis, and the projecting member forms a part of the transport path at the first position.

18. The toner cartridge according to claim 17, wherein at the position for forming a part of the transport path, the projecting member includes space keeping members projecting in a thickness direction of the transported recording medium from both end portions of the projecting member in a direction orthogonal to a transporting direction of the recording medium.

19. The toner cartridge according to claim 18, wherein the projecting member includes a plurality of ribs arranged in the transporting direction of the recording medium between the space keeping members and projecting in the thickness direction of the transported recording medium to a smaller extent than the space keeping members.

20. A toner cartridge detachably mountable to an image forming apparatus, comprising:

a cylindrical casing accommodating a developing agent; and a projecting member formed on an outer periphery of the casing, wherein the projecting member includes a sheet guide surface extending in a tangential direction of the outer periphery of the casing, and a part of the outer periphery of the casing and the sheet guide surface form a part of a transport path of a recording medium in a state where the toner cartridge is mounted in the image forming apparatus.

* * * * *